US009503797B2

(12) United States Patent
Buisker et al.

(10) Patent No.: US 9,503,797 B2
(45) Date of Patent: Nov. 22, 2016

(54) AUDIO AND DISPLAY SYSTEM

(71) Applicant: Daktronics, Inc., Brookings, SD (US)

(72) Inventors: Matt Buisker, Brookings, SD (US); David Sturzenbecher, Sioux Falls, SD (US); Dean Dodge, Oro Valley, AZ (US); Dustin Treml, Brookings, SD (US)

(73) Assignee: Daktronics, Inc., Brookings, SD (US)

( * ) Notice: Subject to any disclaimer, the term of this patent is extended or adjusted under 35 U.S.C. 154(b) by 559 days.

(21) Appl. No.: 13/842,829

(22) Filed: Mar. 15, 2013

(65) Prior Publication Data

US 2014/0177896 A1 Jun. 26, 2014

Related U.S. Application Data

(60) Provisional application No. 61/740,907, filed on Dec. 21, 2012.

(51) Int. Cl.

| | |
|---|---|
| ***H04R 1/02*** | (2006.01) |
| ***G09F 9/33*** | (2006.01) |
| ***G09F 27/00*** | (2006.01) |
| *H04R 1/26* | (2006.01) |

(52) U.S. Cl.

CPC ..... *H04R 1/028* (2013.01); *G09F 9/33* (2013.01); *G09F 27/00* (2013.01); *H04R 1/26* (2013.01); *Y10T 29/49002* (2015.01)

(58) Field of Classification Search

None

See application file for complete search history.

(56) References Cited

U.S. PATENT DOCUMENTS

| | | | | |
|---|---|---|---|---|
| 8,350,788 | B1 * | 1/2013 | Nearman et al. | 345/83 |
| 2003/0058191 | A1 * | 3/2003 | Yuhara et al. | 345/44 |
| 2005/0047617 | A1 * | 3/2005 | Lee | 381/306 |
| 2005/0060921 | A1 * | 3/2005 | Glynn | 40/591 |
| 2005/0122439 | A1 * | 6/2005 | Chang | 348/834 |
| 2008/0244944 | A1 * | 10/2008 | Nall et al. | 40/544 |
| 2008/0266206 | A1 * | 10/2008 | Nelson et al. | 345/1.3 |
| 2009/0146919 | A1 * | 6/2009 | Kline et al. | 345/46 |
| 2011/0242504 | A1 * | 10/2011 | Olcott | G03B 21/26 353/98 |

* cited by examiner

*Primary Examiner* — Quoc D Tran
*Assistant Examiner* — Qin Zhu
(74) *Attorney, Agent, or Firm* — Schwegman Lundberg & Woessner, P.A.

(57) ABSTRACT

An audio and display system comprising a housing having an interior region, at least one audio speaker positioned within the interior region, and a display coupled to the housing. The display includes a frame coupled to the housing, the frame having a plurality of mounting members, wherein at least two adjacent mounting members of the plurality of mounting members are spaced apart by a first distance, a plurality of support members coupled to the mounting members of the frame, wherein at least two adjacent support members of the plurality of support members are spaced apart by a second distance, and a plurality of light-emitting elements coupled to each of the plurality of support members, wherein the display module is substantially acoustically transparent.

12 Claims, 18 Drawing Sheets

AUDIO AND DISPLAY SYSTEM

CLAIM OF PRIORITY

This non-provisional patent application claims the benefit of priority under 35 U.S.C. §119(e) to U.S. Provisional Patent Application Ser. No. 61/740,907, entitled "AUDIO AND DYNAMIC DISPLAY SYSTEM," filed on Dec. 21, 2012, which is hereby incorporated by reference in its entirety.

BACKGROUND

Some examples of displays incorporate an arrangement of different colored light-emitting elements, such as light-emitting diodes (LEDs), for example red-green-blue element pixel packages. In some examples, displays have been used to display graphics or video content such as various advertisements for products and companies. The displays can be used in exterior environments, such as in an outdoor stadium or arena, or in an interior environment, such as an indoor stadium, arena, or venue. Displaying various advertisements over the course of a time period (e.g., a sports game held at a stadium) can generate monetary gain for the establishment.

Sound systems are also used in the exterior and interior environments and can increase the overall experience for occupants. Some examples of sound systems incorporate a static advertisement such as a scrim that includes a printed advertisement. However, since the static advertisements can only display a single advertisement the amount of monetary gain is limited.

Overview

The present inventors have recognized, among other things, that a problem to be solved includes providing a display over a speaker without sacrificing the quality of the sound. For example, existing systems and methods for providing an advertisement over a speaker includes a static advertisement (e.g., a scrim including a printed advertisement) where only a single advertisement can be displayed over a time period (e.g., a sporting game). The present subject matter provides a solution to this problem, by providing an acoustically transparent display that is coupled to a housing that includes at least one audio speaker. The acoustically transparent display of the present disclosure provides little to no adverse effect to sound quality and can be used to display a plurality of advertisements over the course of a time period.

In an example, the present subject matter provides an audio and display system comprising a housing having an interior region, at least one audio speaker positioned within the interior region, and a display coupled to the housing. The display includes a frame coupled to the housing, the frame having a plurality of mounting members, wherein at least two adjacent mounting members of the plurality of mounting members are spaced apart by a first distance, a plurality of support members coupled to the mounting members of the frame, wherein at least two adjacent support members of the plurality of support members are spaced apart by a second distance, and a plurality of light-emitting elements coupled to each of the plurality of support members, wherein the display module is substantially acoustically transparent.

In another example, the present subject matter provides a display comprising a frame having a plurality of mounting members, wherein at least two adjacent mounting members of the plurality of mounting members are spaced apart by a distance. The display includes at least one support member mounted to the plurality of mounting members, the at least one support member defining a plurality of cavities, wherein a support member area is provided by a total support member footprint area excluding a total cavity area, and a plurality of light-emitting elements coupled to the plurality of support member, wherein the display is substantially acoustically transparent.

In another example, the present subject matter provides a display comprising a frame having a plurality of mounting members, wherein at least two adjacent mounting members of the plurality of mounting members are spaced apart by a first distance, a plurality of support members mounted to the plurality of mounting members, wherein at least two adjacent support members of the plurality of support members are spaced apart by a second distance, and a plurality of light-emitting elements coupled to each of the plurality of support members, wherein the display module is substantially acoustically transparent.

In another example, the present subject matter provides a method of manufacturing a display system comprising mounting a plurality of light-emitting elements along each of a plurality of support members, providing or obtaining a frame having a plurality of mounting members spaced apart by a first distance, and coupling the plurality of support members to the plurality of mounting members such that each of the plurality of support members are spaced apart by a second distance so that the frame and the plurality of support members are substantially acoustically transparent.

These and other examples and features of the present audio and display module and related methods will be set forth, in part, in the following Detailed Description. This Overview is intended to provide an overview of subject matter of the present disclosure and is not intended to provide an exclusive or exhaustive explanation. The Detailed Description below is included to provide further information about the present subject matter.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

In the following Detailed Description, reference is made to the accompanying drawings which form a part hereof. The drawings show, by way of illustration, specific examples in which the present audio and display systems and related methods can be practiced. These examples are described in sufficient detail to enable those skilled in the art to practice, and it is to be understood that other embodiments can be utilized and that structural changes can be made without departing from the scope of the present disclosure. Therefore, the following Detailed Description is not to be taken in a limiting sense, and the scope of the present disclosure is defined by the appended claims and their equivalents.

Figure 1:
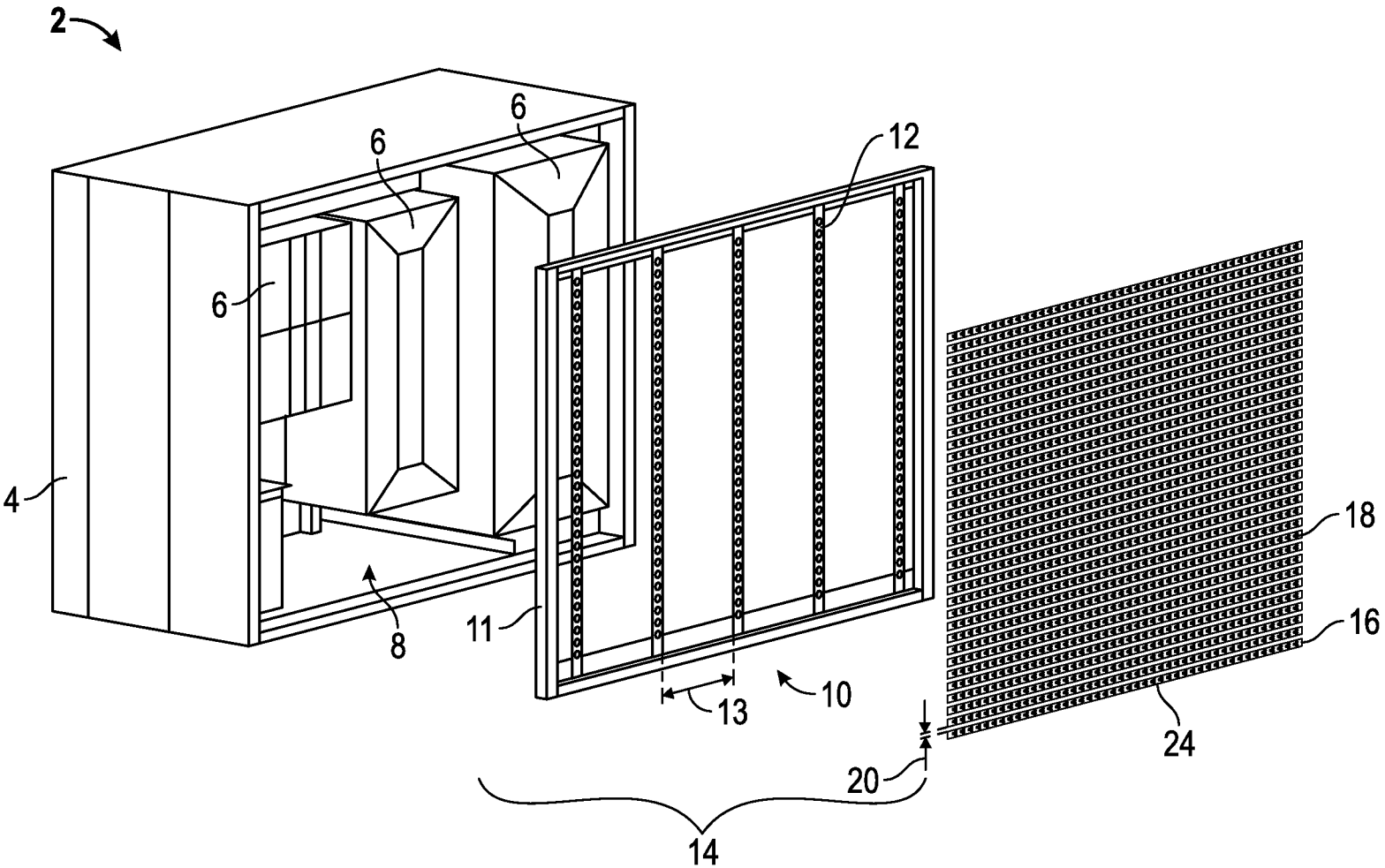
FIG. 1 illustrates an exploded view of an example audio and display system.

FIG. 1 shows an exploded view of an example of an audio and display system 2. The audio and display system 2 can include a housing 4, at least one audio speaker 6, a display module 14. The housing 4 can have an interior region 8 with the at least one audio speaker 6 can be positioned within the interior region 8. The at least one audio speaker 6 can include a sound producing device that is capable of producing acoustical energy. In an example, the at least one audio speaker 6 can include, but is not limited to, a subwoofer, a woofer, a full-range speaker, a mid-range speaker, a low-range speaker, a tweeter, and a combination thereof. In an example, the at least one audio speaker 6 is configured to provide an audio frequency within a range of from about 20 hertz to about 20,000 hertz. The at least one audio speaker 6 can include a plurality of audio speakers 6, wherein each individual audio speaker 6 can be configured to provide a sub-range of audio frequencies, wherein, in total, the plurality of audio speakers 6 provide for an audio frequency over a desired total range, such as from about 20 hertz to about 20,000 hertz.

The display module 14 can include a frame 10, a plurality of support members 16, and a plurality of light-emitting elements 18. The frame 10 can include a frame body 11 and a plurality of mounting members 12 extending between the frame body 11. At least two adjacent mounting members 12 of the plurality of mounting members 12 can be spaced apart by a first distance 13. In an example, each of the mounting members 12 of the plurality of mounting members 12 can be spaced apart from an adjacent mounting member 12 by the first distance 13. Additionally, each of the plurality of mounting members 12 can be spaced apart from an adjacent mounting member 12 by at least the first distance 13.

The plurality of light-emitting elements 18 can be coupled to each of the plurality of support members 16. In an example, at least two adjacent support members 16 of the plurality of support members 16 are spaced apart by a second distance 20. In another example, each of the support members 16 of the plurality of support members 16 can be spaced apart from adjacent support members 16 by at least the second distance 20. The display module 14 can also include a plurality of light-emitting elements 18. The plurality of support members 16 can be coupled to the mounting members 12 of the frame 10.

The display module 14 can include a front display surface 24 that can be configured to provide a display of graphics or video content. The front display surface 24 can be formed from the plurality of light-emitting elements 18 coupled to the plurality of support members 16. In an example, the light-emitting elements 18 can comprise light-emitting diode (LED) devices, although other types of light-emitting devices can be used. For the sake of brevity, the remainder of this disclosure will describe the light-emitting elements 18 as LEDs 18. However, a person of skill in the art will understand that other types of light-emitting devices can be contemplated.

When multiple LEDs 18 are positioned together in close proximity, various colors can be shown by combining the colors of one or more of the LEDs 18. In an example, the front display surface 24 can include an array of LED pixels, with each LED pixel including a red LED, a green LED, and a blue LED. The red, green, and blue LEDs can cooperate to provide a spectrum of colors when one, two, or three of the light emitting elements in a pixel are lit at varying intensities. The front display surface 24 can also provide a black or empty looking surface over a portion of the display, when desired, by deactivating or turning off the LEDs in a particular portion of the front display surface 24. The front display surface 24 of the display module 14 can be combined with front display surfaces of one or more adjacently-positioned displays modules to form a front display surface of a larger display module.

In an example, the display module 14 can be coupled to the housing 4 opposite of a sound producing portion of the at least one audio speaker 6. In an example, the display module 14 is not coupled to housing but is coupled to the audio speaker 6. In another example, the display module 14 is not coupled to either the housing 4 or the audio speaker 6 but is placed in front of one or more audio speakers 6.

As discussed herein, the display module 14 can form a substantially acoustically transparent display. That is, sound produced from the at least one audio speaker 6 can pass through the display module 14 (e.g., the frame 10 and the plurality of support members 16 including the plurality of LEDs 18) without being substantially adversely affected. In this document, the term "substantially acoustically transparent" is used to include a frequency response measurement taken as sound passes through the display module 14 that varies by less than an acceptable decibel deviation threshold. The acceptable decibel deviation threshold can depend on the environment in which the audio and display system 2 is to be operating. For example, if the audio and display system 2 is to be used in a large, open-air stadium, a relatively small decibel deviation threshold may be acceptable. If the audio and display system 2 is being used in a small, indoor space, than a relatively larger decibel deviation threshold may be acceptable. In an example, the decibel deviation threshold can be no more than about six (6) decibels from a frequency response measurement taken without the display module 14. In another example, the decibel deviation threshold can be no more than about five (5) decibels from a frequency response measurement taken without the display module 14. In yet another example, the decibel deviation threshold can be no more than about four (4) decibels from a frequency response measurement taken without the display module 14.

In still another example, the decibel deviation threshold can be no more than about three (3) decibels from a frequency response measurement taken without the display module 14.

Figure 2:
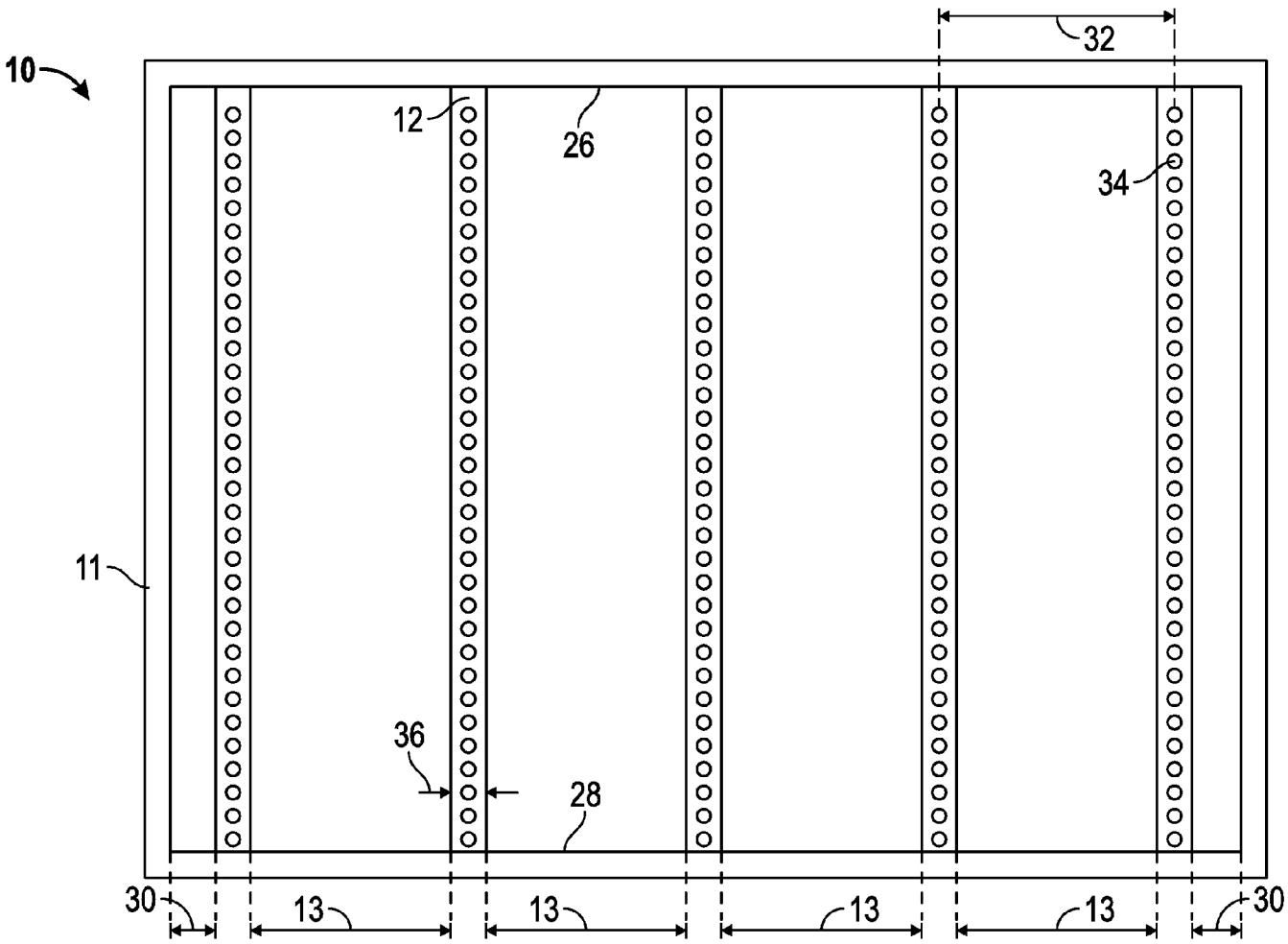
FIG. 2 illustrates an example of a frame for use in an audio and display system.

FIG. 2 illustrates an example of a frame 10. The example frame 10 can include the frame body 11 and the plurality of mounting members 12. The plurality of mounting members 12 can extend from a first side 26 of the frame body 11 to a second side 28 of the frame body 11, where the second side 26 is opposite of the first side 24. In the example shown in FIG. 1, the plurality of mounting members 12 are provided in a substantially vertical alignment. In another example, the plurality of mounting members 12 can be provided in a substantially horizontal alignment. In yet another example, the plurality of mounting members 12 can be positioned at an angle relative to a vertical direction and a horizontal direction.

At least two adjacent mounting members 12 of the plurality of mounting members 12 can be spaced apart by a first distance 13. In an example, the first distance 13 can be equal to or greater than 20 millimeters. For example, the first distance 13 can be a minimum spacing between the plurality of mounting members 12 that can provide for adequate mechanical support to the display module 14, but which does not substantially adversely affect the sound quality of the at least one audio speaker 6 (shown in FIG. 1) so that the display module 14 is substantially acoustically transparent. In an example, the first distance 13 can be from about 20 millimeters to about 2000 millimeters. In another example, the first distance can be about 500 millimeters. As illustrated in FIG. 2, each mounting member 12 is spaced apart from adjacent mounting members 12 by the first distance 13. In an example, the distance between adjacent mounting members 14 can vary along a length of the frame 10.

A distance 30 between the ultimate mounting members 12 and the frame 10 can be the same or different from the first distance 13. In an example, the distance 30 can be from about 20 millimeters to about 2000 millimeters.

The plurality of mounting members 12 can have a rectangular cross-sectional shape. However, the plurality of mounting members 12 can have a number of different cross-sectional shapes. For example, the cross-sectional shape of the plurality of mounting members 12 can include, but is not limited to, circular, ovular, square, triangular, trapezoidal, polygonal, parallelogram, rhomboidal, and other irregular shapes. A mounting member thickness 36 can be from about 2.5 millimeters to about 75 millimeters. In an example, the mounting member thickness 36 can be about 25 millimeters. The mounting member thickness 36 is a thickness of the mounting member 36 in a direction that is orthogonal to the direction of sound travel and can be the same for each mounting member 12 of the plurality of mounting members 12. Additionally, the mounting member thickness 36 of each mounting member 12 of the plurality of mounting members 12 can vary between each mounting member 12.

A mounting member center-to-center distance 32 between adjacent mounting members 12 of the plurality of mounting members 12 can be from about 20 millimeters to about 2000 millimeters. In an example, the mounting member center-to-center distance 32 can be about 500 milliliters. The mounting member center-to-center distance 32 between each adjacent mounting member 12 of the plurality of mounting members 12 can be the same. Additionally, the mounting member center-to-center distance 32 between each adjacent mounting member 12 of the plurality of mounting members 12 can be different.

The plurality of mounting members 12 can include a plurality of connection holes 34. The plurality of connection holes 34 can be a threaded hole configured to receive a screw for coupling the display module 14 (as shown in FIG. 1) to the frame 10. However, as discussed herein, various coupling structures and techniques can be used to couple the display 14 to the frame 10.

In an example, the frame body 11 and the plurality of mounting members 12 can be manufactured as an integral body. In another example, the frame body 11 and the plurality of mounting members 12 can be formed separately and subsequently coupled together. The frame 10 can be manufactured to minimize potential vibration caused by the at least one audio speaker 6 (as shown in FIG. 1). For example, the frame body 11 and the plurality of mounting members 12 can be formed from a thermoplastic material or other materials that do not transmit vibrations and do not resonate to either vibrations or harmonics of vibrations. Moreover, the frame body 11 and the plurality of mounting members 12 can be coupled using hardware (e.g., pins, screws, and clips) formed from the thermoplastic material or other materials that do not transmit vibrations and do not resonate to either vibrations or harmonics of vibrations.

Figure 3:
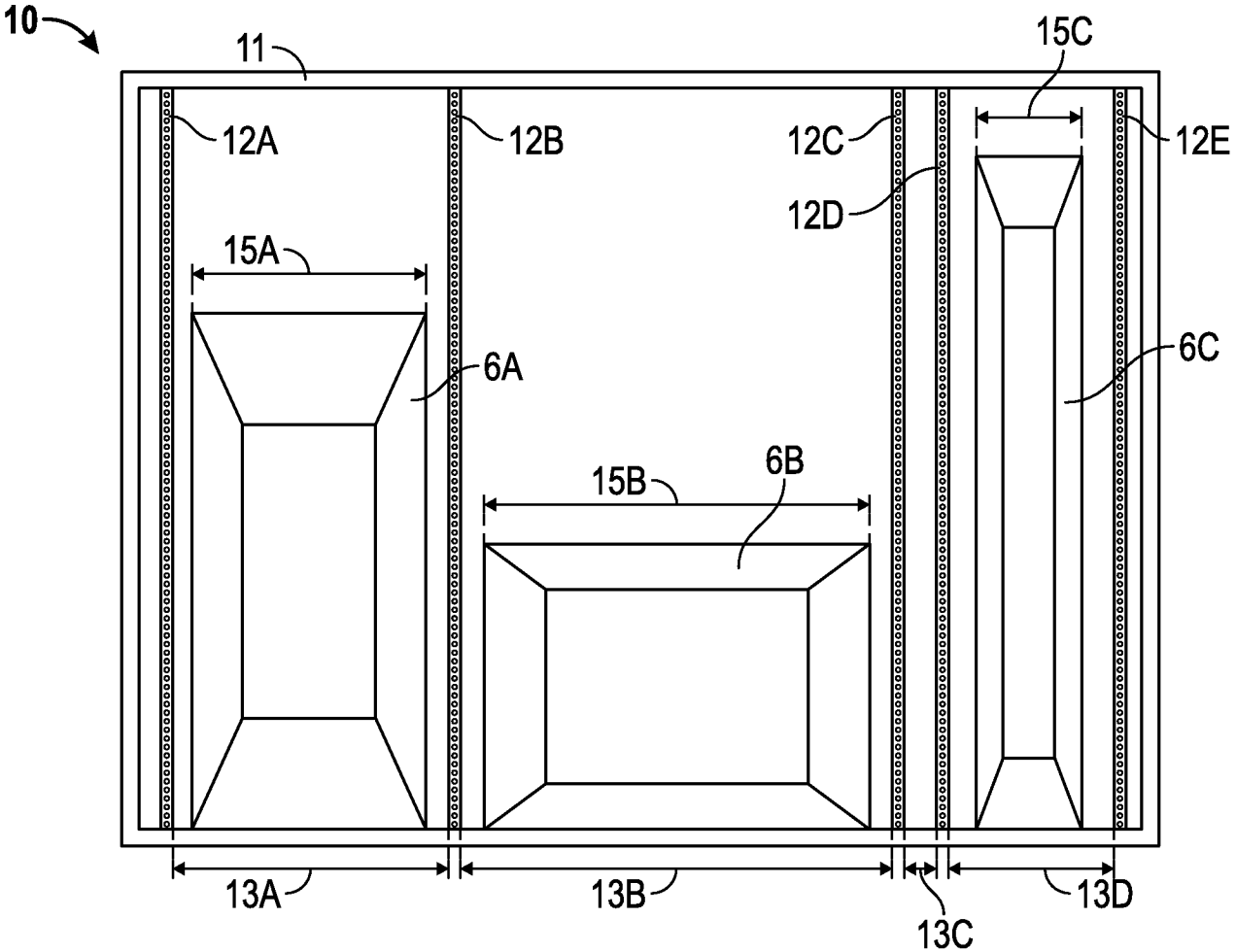
FIG. 3 illustrates a front view of an example frame 10 positioned in front of a plurality of audio speakers 6.

FIG. 3 illustrates a front view of an example frame 10 positioned in front of a plurality of audio speakers 6A-6C (collectively referred to as "audio speakers 6"). Each of the audio speakers 6A-6C can have a respective width 15A-15C. The example illustrated in FIG. 3, the frame 10 includes the frame body 11, a plurality of mounting members 12A-12E (collectively referred to as "mounting members 12"). As illustrated in FIG. 3, the distances 13A-13D (collectively referred to as "distances 13") between the plurality of mounting members 12A-12E vary. For example, the distances 13 are configured such that the plurality of mounting members 12A-E are not positioned directly in front of the plurality of speakers 6A-6C. In other words, the distances 13 between adjacent mounting members 16 can be equal to or greater than a width of a speaker positioned between the two adjacent mounting members 16. For example, the distance 13A between mounting members 12A and 12B can be equal to or greater than the width 15A of the audio speaker 6A. Similarly, the distance 13B between mounting members 12B and 12C can be equal to or greater than the width 15B of the audio speaker 6B and the distance 13D between mounting members 12D and 12E can be equal to or greater than the width 15C of the audio speaker 6C. In the example illustrated in FIG. 3, an audio speaker is not positioned between mounting member 12C and 12D and the distance 13C between the mounting members 12C and 12D can be less than the distances 13A, 13B, and 13D. As discussed herein, the number and spacing of the mounting members 12 can vary depending on the type and number of audio speakers 6 and the support needs of the plurality of support members that is to be mounted to the frame 10.

Figure 4A:
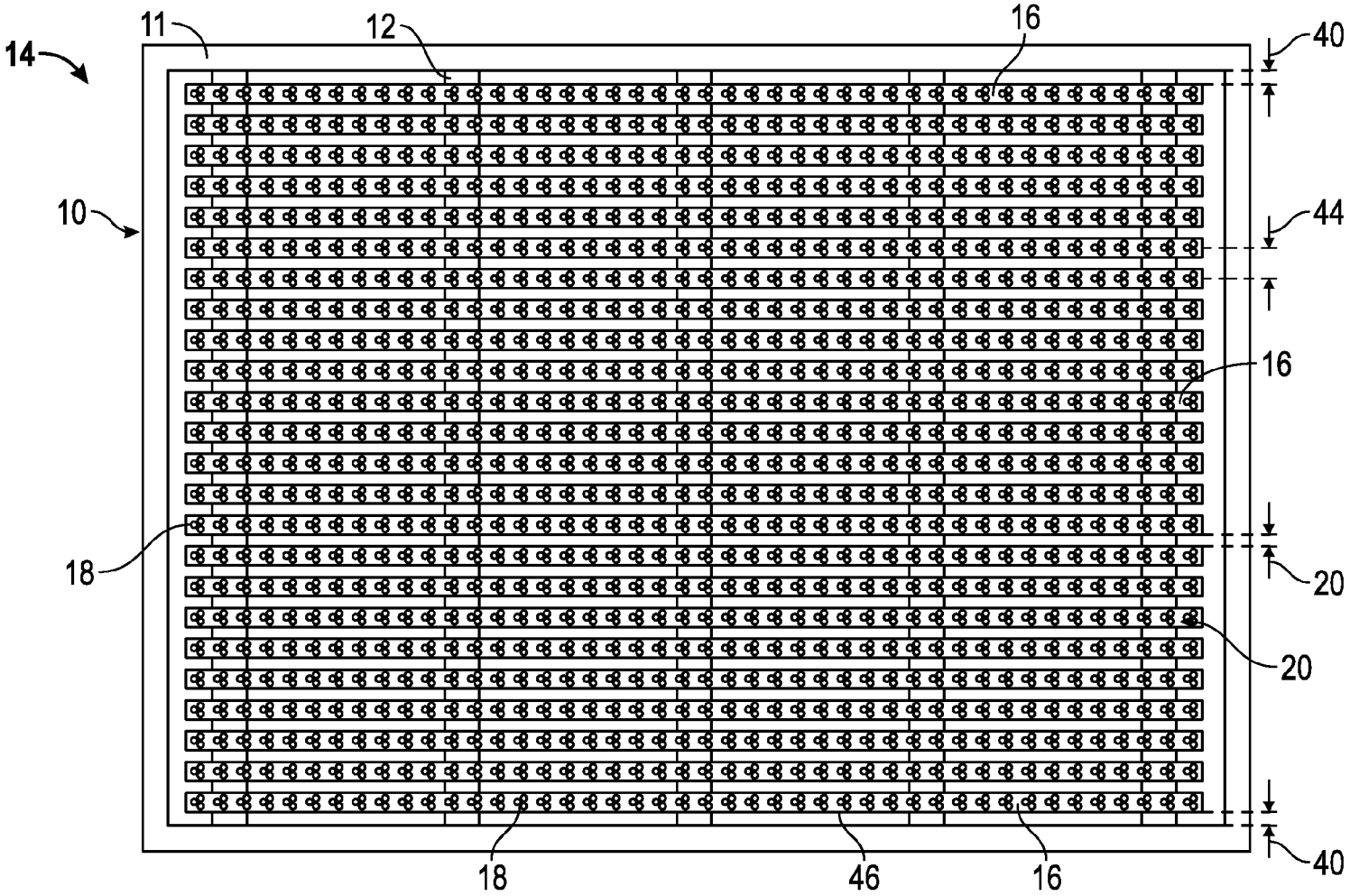
FIG. 4A illustrates a front view of an example display module for use in an audio and display system.
Figure 4B:
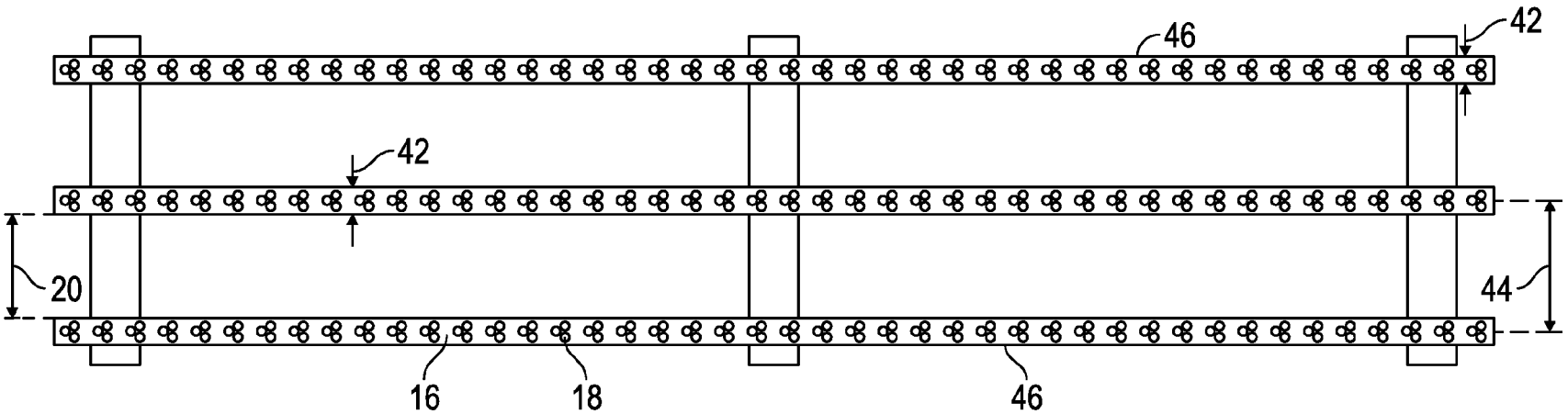
FIG. 4B illustrates a close-up view of a portion of the display module in FIG. 4A.

FIG. 4A illustrates a front view of an example display module 14. FIG. 4B illustrates a close-up view of a portion of the display 14 in FIG. 4A. The display module 14 can include the frame 10 coupled to the plurality of support members 16 including the plurality of LEDs 18. As discussed herein, the frame 10 can include the frame body 11 and the plurality of mounting members 12 extending between the frame body 11.

The plurality of support members 16 can have an elongate body 46. The plurality of LEDs 18 can be coupled to the plurality of support members 16. The plurality of support members 16 and the plurality of LEDs 18 can form the front display surface 24 that is configured to provide for a display of graphics or video content. The plurality of support members 16 can be aligned in a direction that is substantially perpendicular to the plurality of mounting members 12 of the frame 11. In the example shown in FIG. 4A, the plurality of support members 16 are provided in a substantially horizontal alignment while the mounting members 12 are provided in a substantially vertical alignment. In another example, the plurality of mounting members 12 can be positioned at an acute angle relative to the plurality of mounting members 12.

At least two adjacent support members 16 of the plurality of support members 16 can be spaced apart by the second distance 20. The second distance 20 can be from about 10 millimeters to about 100 millimeters. The second distance 20 is a distance between adjacent support members 16 of the plurality of support members 16 that does not adversely affect the sound quality of the at least one audio speaker 6 (as shown in FIG. 1). Additionally, the second distance 20 is a distance between adjacent support members 38 of the plurality of support members 16 that does not adversely affect the visual quality of the display module 14, e.g., that can still provide for adequate pixel resolution of the display module 14. In an example, the second distance 20 can be about 25 millimeters. The second distance 20 between each adjacent support member 16 of the plurality of support members 16 can be the same or it can vary throughout the display module 14.

A distance 40 between the ultimate mounting members 16 and the frame 10 can be the same or different from the second distance 20. In an example, the distance 40 can be from about 0.5 millimeters to about 100 millimeters. A support member thickness 42 in a direction generally orthogonal to the direction of sound travel (as shown in FIG. 3B) can be from about 5.0 millimeters to about 50.0 millimeters. In an example, the support member thickness 42 can be about 12.5 millimeters. The support member thickness 42 can be the same for each support member 16 of the plurality of support members 16. The support member thickness 42 can be selected to provide for minimal interference with the sound from the at least one speaker 6, but that is also wide enough to provide for a desired arrangement of the LEDs 18 (e.g., to support the triangle LED pixel arrangement shown in FIG. 3B or any other desired LED arrangement). The support member thickness 42 for each support member 16 of the plurality of support members 16 can vary between each mounting member 16.

A support member center-to-center distance 44 between adjacent support members 16 of the plurality of mounting members 16 can be from about 5 millimeters to about 100 millimeters. In an example, the support member center-to-center distance 42 can be about 25 millimeters. The support member center-to-center distance 42 between each adjacent support member 16 of the plurality of support members 16 can be the same. Additionally, the support member center-to-center distance 42 between each adjacent support member 16 of the plurality of support members 16 can be different from each other.

In an example, each of the plurality of support members 16 can be independent from the other support members 16 and individually coupled to the frame 10 such that at least two adjacent support members 16 are spaced apart by the second distance 20. In another example, the plurality of support members 16 can be coupled together such that at least two adjacent support members 16 are spaced apart by the second distance 20. For example, a wire can be woven around the plurality of support members 16 to maintain the second distance 20 between at least two adjacent support members 16 of the plurality of support members 16.

In an example, the plurality of support members 16 can define a plurality of cavities 17 between adjacent support members 16. A total support member area is less than a total display footprint area. The total display footprint area can be the area defined by the perimeter of support member, including the area of the support members and the area of the cavities (e.g., space between support members). In an example, the total display footprint area can be equal to or less than seventy five percent of the total display footprint area. Stated differently, the total cavity area is at least 25 percent of the total display footprint area. In another example, the total cavity area can be about 35 percent of the total support member footprint area. In an example, the plurality of cavities 17 defined by the spaced apart support members 16 can provide a total support member area percentage threshold of the total support member footprint area that allows the plurality of support members 16 to be substantially acoustically transparent and not adversely affect the sound quality. That is, sound produced from the at least one audio speaker 6 (as shown in FIG. 1) can pass through at least the plurality of support members 16 including the plurality of LEDs 18) without being substantially adversely affected.

Figure 5:
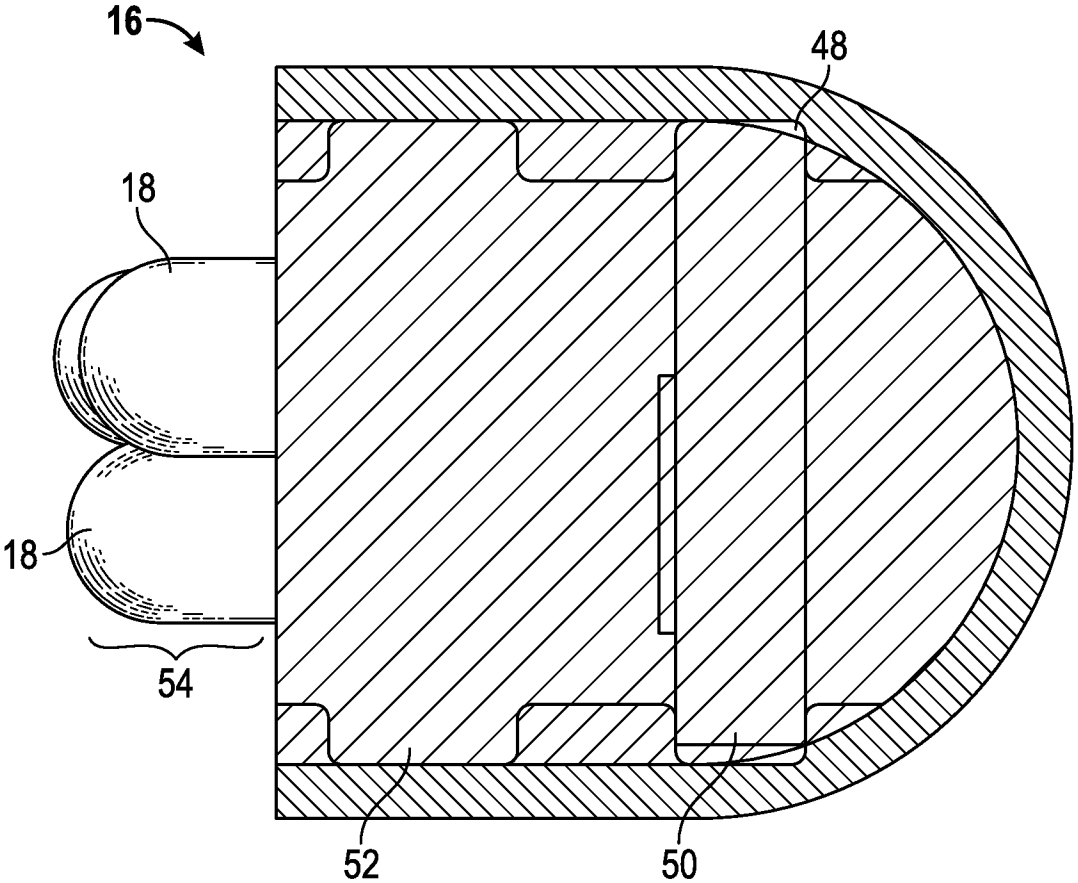
FIG. 5 illustrates a cross-sectional view of an example support member for use in an audio and display system.

FIG. 5 illustrates a cross-section of a support member 16. For simplicity, the cross-section of the display module 14 includes a cross-section of a single support member 16 including a plurality of LEDs 18. The elongate body 46 (as shown in FIGS. 4A and 4B) of the support member 16 can include a recess 48 that extends in a longitudinal direction of the elongate body 46 (as shown in FIGS. 4A and 4B). The support member 16 can be formed from materials including, but not limited to, extruded metal and molded plastic.

One or more circuit boards 50 (e.g., printed circuit boards) and a plurality of LEDs 18 can be coupled to the support member 16. The plurality of LEDs 18 can be electrically coupled to the circuit board 50. In an example, the LEDs 18 can comprise through-hole technology, where an LED includes a lead pin that can be inserted through a hole in the circuit board and where the lead pin can be soldered to a connection pad on the back side of the circuit board. In another example, the LEDs 18 can comprise surface-mount technology (SMT) LEDs, also referred to as surface-mount LEDs. A surface-mount LED is mounted directed onto the front face of a circuit board by being soldered directly to solder pads. Surface-mount LEDs can be smaller than through-hole LEDs and can take up less space on the circuit board.

The one or more circuit boards 50 can be disposed within the recess 48 of the support member 16. For example, the one or more circuit boards 50 can be coupled to the support member 16 by, for example, an interference fit, gluing, locking, or integration. At least a portion 54 of the plurality of LEDs 18 can project from the recess 48.

In an example, the support member 16 can include an encapsulant 52 disposed within the recess 48. The encapsulant 52 can be incorporated into the support member 1816 for environmental protection. The encapsulant 52 can substantially cover at least a portion of the circuit board 50 and a portion of the plurality of LEDs 18. For example, the portion of the plurality of LEDs 18 that is disposed within the recess 48. Additionally, the encapsulant 52 can fill the recess 48 and substantially seal off the recess 48 from exterior environment, e.g., to substantially seal the circuit board 50 and any electrical connections between the LEDs 18 and the circuit board from moisture or other contaminants. The encapsulated circuit board 50 can be coupled with the support member 16 and can be configured for use in an exterior environment, such as in an outdoor stadium or arena, or in an interior environment, such as an indoor stadium, arena, or venue. In an example, the encapsulant is dispensed through a nozzle into the recess 48 formed by the plurality of support members 16. For example, a precision metering system can be used to dispense the encapsulant into the recess 48 until at least the circuit board 50 is covered. In an example, the encapsulant is delivered until the open volume of the recess 48 is filled.

Examples of materials that can be used for the encapsulant 52 include, but are not limited to, silicones and polyurethanes. In an example, the encapsulant 52 can be molded from a silicone encapsulant, such as silicone electronics encapsulants manufactured by Dow Corning Corp., Midland, Mich., USA, such as Dow Corning EE-1184 silicone encapsulant.

Figure 6:
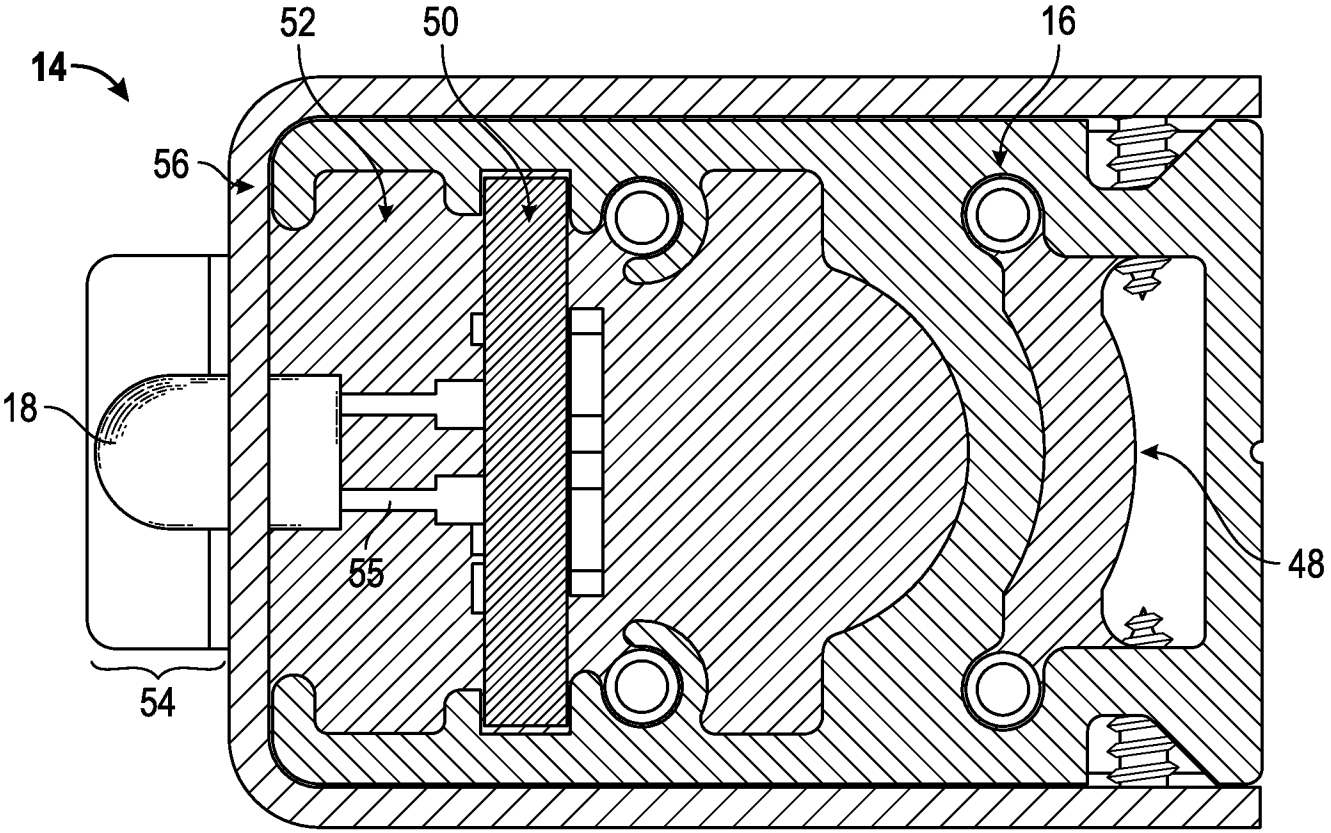
FIG. 6 illustrates a cross-sectional view of an example support member for use in an audio and display system.

FIG. 6 illustrates a cross-sectional view of an example support member. The display module 14 in FIG. 5 includes a recess 48 formed by the support member 16. A circuit board 50 is disposed within the recess 48 of the support member 16. The plurality of LEDs 18 can be electrically coupled to the circuit board 50, e.g., via contact wires 55. A portion 54 of the plurality of LEDs 18 can project from the recess 48. The display module 14 can include the encapsulant 52 as discussed herein with regards to FIG. 4.

The example illustrated in FIG. 6 can include a contrast enhancement element 56. The contrast enhancement element 56 can provide additional contrast to the display. The contrast enhancement element 56 can be positioned around the LED 18 at a front surface of the support member 16. In an example, the contrast enhancement element 56 can be positioned on side surfaces of the support member 16. Examples of materials that can be used for the contrast enhancement element 56 include, but are not limited to stamped, extruded or molded metal or plastic such as 5052 aluminum sheet, 1034 steel, polycarbonate.

In an example, the contrast enhancement element 56 can be coupled to or onto or around the support member 16 including the plurality of LEDs 18. For example, the contrast enhancement element 56 can be coupled to the support member 16 via thread forming screws, rivets, or a snap fit. The contrast enhancement element 56 can also be coupled to the support member 16 via adhesive tapes, epoxies or glues.

Figure 7A:
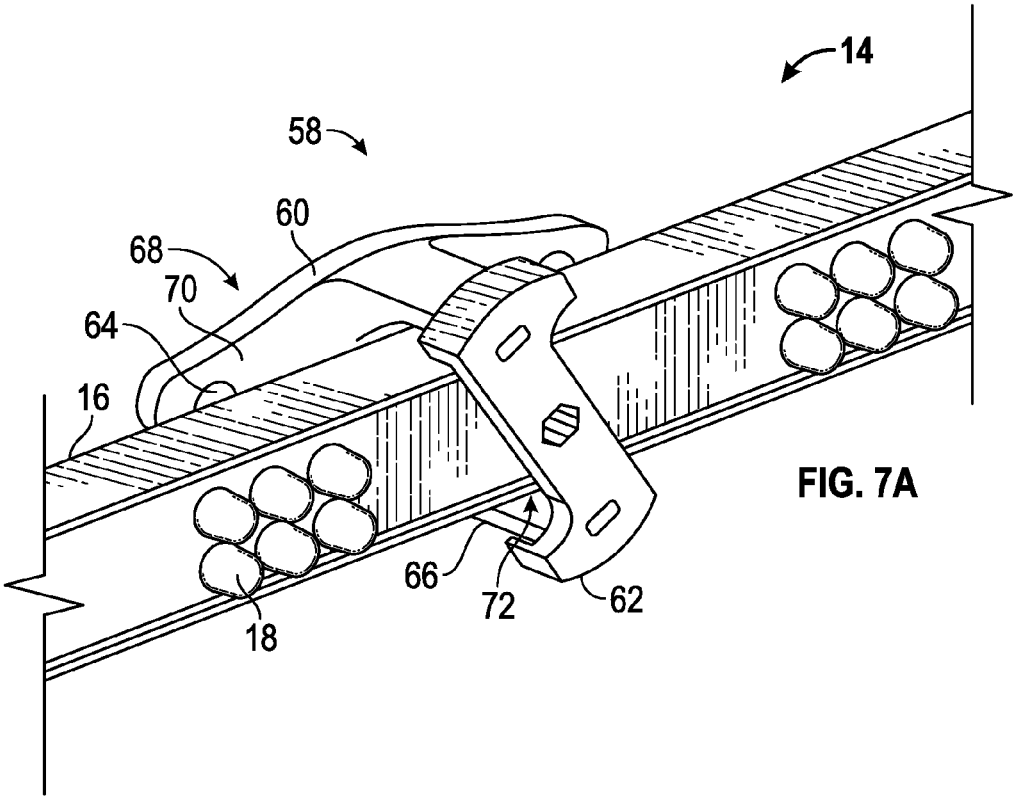
FIGS. 7A and 7B illustrate a perspective view of an example support member and a fastening device.
Figure 7B:
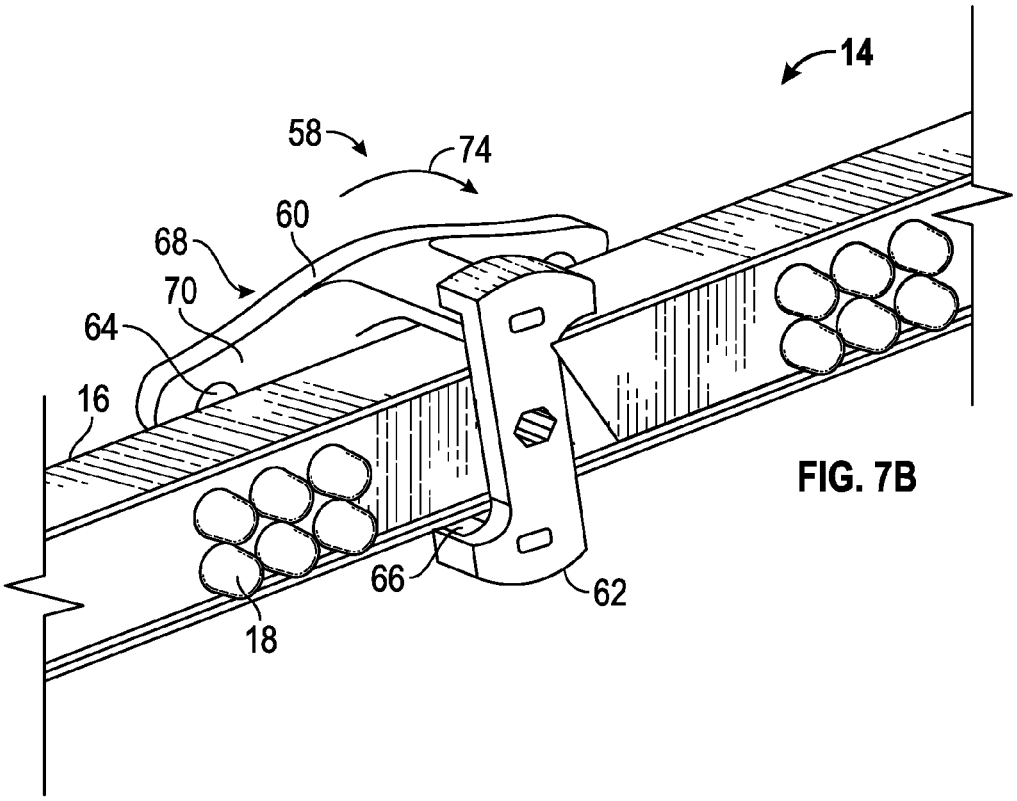

FIGS. 7A and 7B illustrate a perspective view of a display module 14 and a fastening device 58, in accordance with one embodiment of the present disclosure. As described above, the display module 14 includes a support member 16 and a plurality of LEDs 18. Additionally, the recess 48 (as shown in FIGS. 4 and 5) includes the encapsulant 52 disposed with in the recess 48. As discussed herein, the display module 14 can be coupled to the plurality of mounting members 12 of the frame 10. FIG. 7A illustrates an example fastening device 58. The fastening device 58 can include a bracket 60 and a cover 62. The bracket can include a first face 68 configured to contact a surface of a mounting member 12 (shown in FIGS. 1-4). The bracket 60 can include locking holes 64 that can align with the holes 34 of the mounting members (shown in FIGS. 2 and 3) and can be configured to receive a fastener, such as a screw. The bracket 60 can include two compressible extension arms 66 extending from a second face 70 of the bracket 60, the second face 70 opposite of the first face 68. The two compressible extension arms 66 can define a space 72 that is configured to receive the support member 16 including the plurality of LEDs 18.

The fastening device 58 can include a cover 62. When the cover 62 is rotated, the cover 62 is configured to engage with the two extending arms 66 to couple the support member 16 to a mounting member 12 (as shown in FIGS. 1-4). As illustrated in FIG. 7A, the cover 62 is in an unlocked positioned. As illustrated in FIG. 7B, the cover 62 has been rotated in a first direction 74 and the cover 62 has engaged with the compressible extension arms 66 to secure the support member 16 in the space 72. The secured support member 16 is thus coupled to a mounting member 12.

Figure 8:
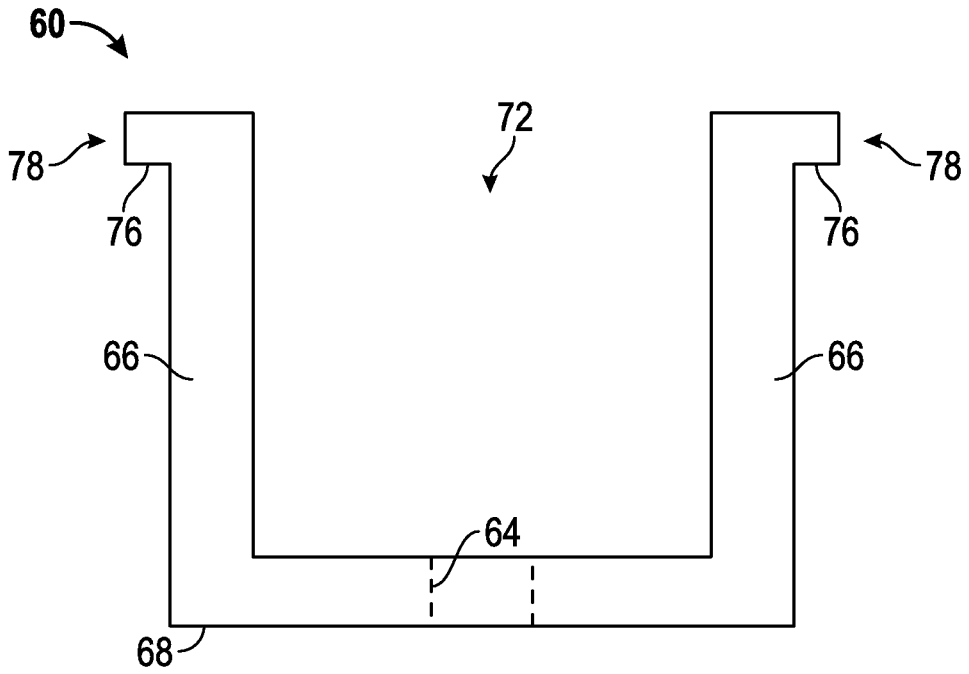
FIG. 8 illustrates a side view of an example bracket for use in an audio and display system.

FIG. 8 illustrates a side-view of a bracket 60. The compressible extension arms 66 extend from a second surface 70 and define the opening 72 configured to receive the support member 16 (as shown in FIGS. 7A and 7B). As illustrated in the example of FIG. 8, distal ends 78 of the compressible extension arms 66 can include a projection 76. As discussed herein, the projection 76 can interact with the cover 62 (shown in FIGS. 6A, 6B, and 8) such that the compressible extension arms 66 are compressed and securely engage with the support member 16.

Figure 9:
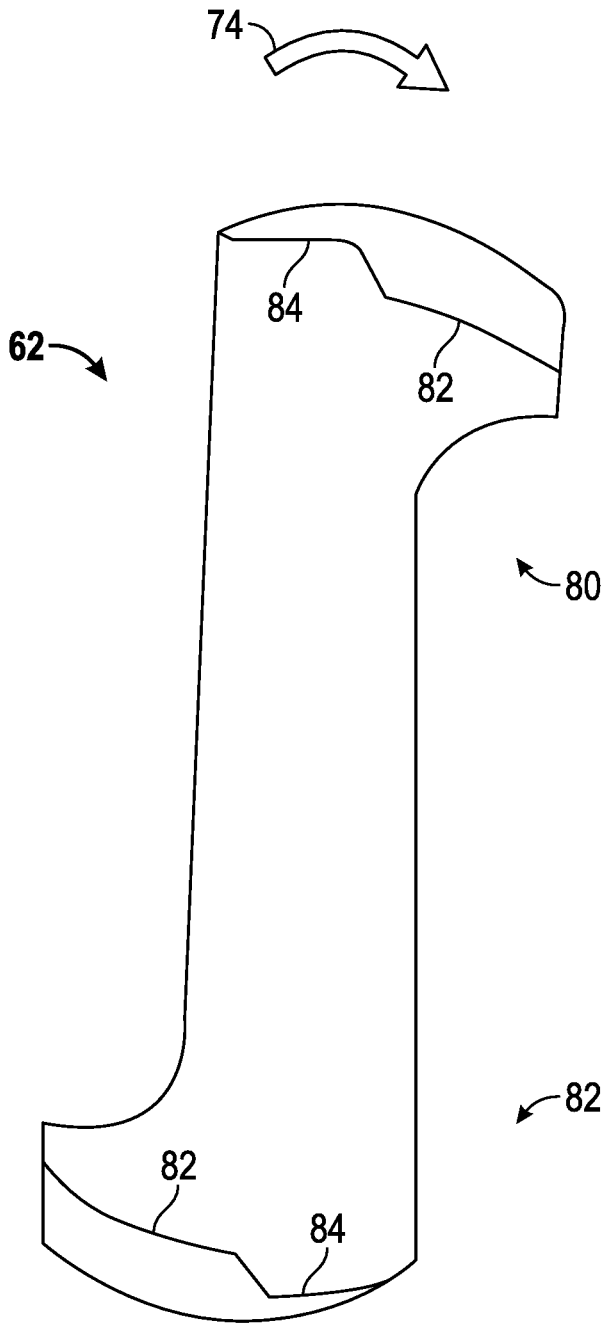
FIG. 9 illustrates a back view of an example cover for use in an audio and display system.

FIG. 9 illustrates a back view of the cover 62. As illustrated in the example of FIG. 9, a first end 80 and a second end 82 each can include a ramped surface 82 and a pocket 84. As the cover 62 is rotated in the first direction 74, the projections 76 of the compressible extension arms 66 (shown in FIG. 8) are configured to move along the ramped surfaces 82 and "snap-fit" into the pocket 94. As the projections 76 move along the ramped surfaces 82 and while positioned within the pocket 94, the compressible extension arms 66 can apply a force to the support member 16. For example, the extension arms 66 can be made from a resilient material or can include a resilient structure mounted thereto that provides a resistance force against the support member 16. The fastening device 58 described with reference to FIGS. 7-9 is just one example of a fastening device 58 that can couple the plurality of support members 16 of the display 14 to the plurality of mounting members 12.

Figure 10B:
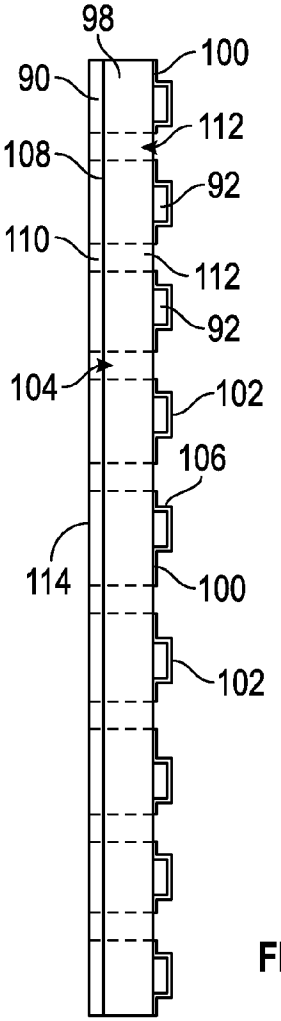
FIG. 10B illustrates a side view of the example of the support member in FIG. 10A.
Figure 10A:
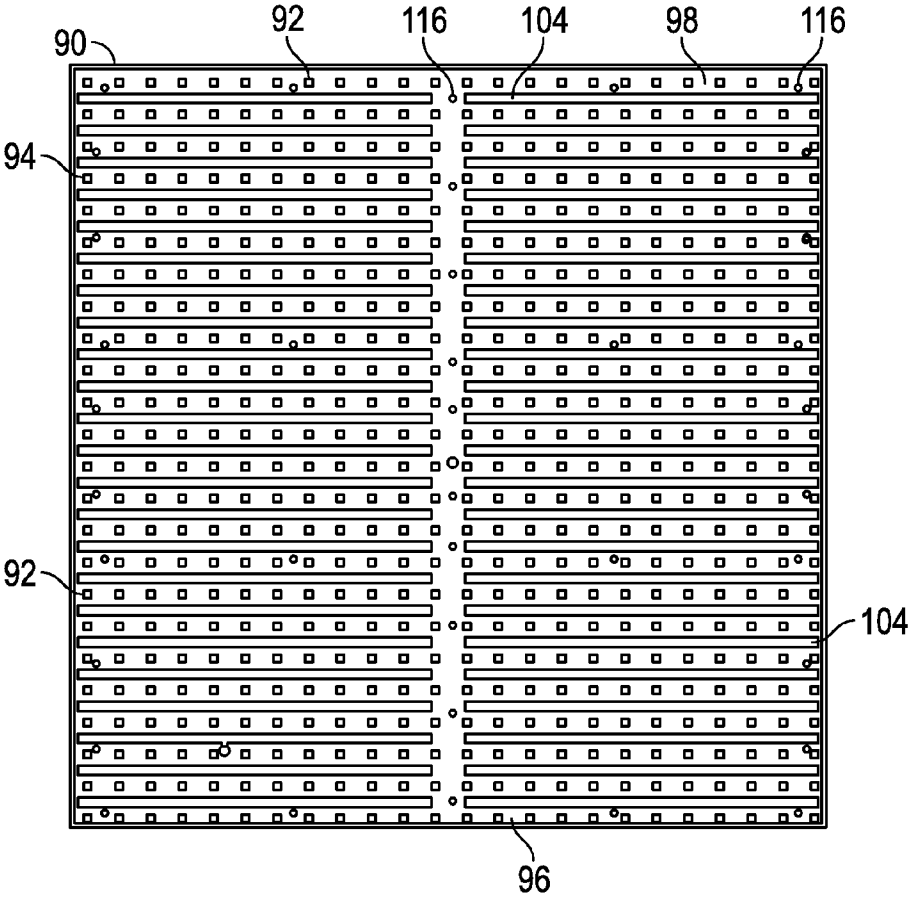
FIG. 10A illustrates a front view of an example of a support member 90 for use in an audio and display.

FIG. 10A illustrates a front view of an example of a support member 90 for use in an audio and display. FIG. 10B illustrates a side view of the example of the support member in FIG. 10A. The support member 90 can be used with the frame 10 (as shown in FIGS. 1-3) to form a substantially acoustically transparent display. For example, the support member 90 can include a plurality of holes 116 that are each configured to receive a screw. The plurality of holes 116 can be aligned with holes 34 of the frame 10 (shown in FIG. 2) and receive a screw to couple the support member 90 to the frame 10. The example in FIG. 10A includes a single support member 90 and a plurality of LEDs 92 coupled to the support member 90. The support member 90 can include a front display surface 96 that can be configured to provide for a display of graphics or video content.

In an example, the support member 90 can define a plurality of cavities 104. In the example shown in FIGS. 10A and 10B, each of the plurality of cavities 104 is provided in a substantially horizontal alignment. In another example, the plurality of cavities 104 can be provided in a substantially vertical alignment or in an angled alignment relative to the horizontal and vertical alignment.

A total support member area can be less than the total display footprint area. The total display footprint area can be the area defined by the perimeter of the support member 90, including the area of the support members and the area of the cavities 104. In an example, the total support member area can be equal to or less than seventy-five percent of the total display footprint area. Stated differently, the total cavity area can be at least about twenty-five percent of the total display footprint area. In another example, the total cavity area can be at least about thirty-five percent of the total display footprint area. In an example, the total support member area can be below a total support member area percentage threshold. The total support member area percentage threshold can be a maximum percentage that the total support member area can occupy of the total display footprint area that will not adversely affect the sound quality from an audio speaker. Maintaining the total support member area below the total support member area percentage can provide a suitable percentage of "open space" provided by the plurality of cavities 104 and allows the support members 90 to be substantially acoustically transparent and not adversely affect the sound quality. That is, sound produced from the at least one audio speaker 6 (as shown in FIG. 1) can pass through at least at one support member 90 including the plurality of LEDs 92) without being substantially adversely affected.

The support member 90 can include a circuit board 98 where the plurality of LEDs 92 can be mounted and electrically coupled to the circuit board 98. For example, the plurality of LEDs 92 can be mounted to a front face 100 of the circuit board 98. In an example, the LEDs 92 can comprise surface-mount LEDs.

As illustrated in FIG. 10B, the plurality of cavities 104 can be formed from an opening 110 in the support member 90 and a corresponding opening 112 in the circuit board aligned or substantially aligned with the support member opening 110. The corresponding openings 110, 112 can form the plurality of cavities 104 that extend form the front face 100 of the circuit board 98 to an back face 114 of the support member 90.

In an example, an encapsulating mask 102 can be formed over at least the front face 100 of the circuit board 98. The encapsulating mask 102 can substantially cover and substantially seal at least a portion of the front face 100 and at least a portion of the LEDs the encapsulating mask 102 can substantially cover and substantially seal at least a portion of the front face 100 and at least a portion of the LEDs 92 mounted to the front face mounted to the front face 100. In an example, the encapsulating mask 102 can include a plurality of projections 106 that are each configured to receive and cover a corresponding LED 92. The material that forms the encapsulating mask 102 can be substantially transparent so that light emitted from the LEDs 92 can be emitted through the encapsulating mask 102. Example of an encapsulating masks that can be used with display modules is described in U.S. Provisional Application Ser. No. 61/735,346, filed on Dec. 10, 2012, entitled "Encapsulation of Light-Emitting Elements on a Display Module," assigned to the assignee of this application, the disclosure of which is incorporated herein by reference in its entirety.

The encapsulated circuit board 98 can be coupled with the support member 90. The support member 90, circuit board 98, and plurality of LEDs 92 can be coupled to the frame 10 (shown in FIGS. 1-3) to form a substantially acoustically transparent display. The display can be configured for use in an exterior environment, such as in an outdoor stadium or arena, or in an interior environment, such as an indoor stadium, arena, or venue.

As shown in FIG. 10, the encapsulating mask 102 can substantially cover the front face 100 of the circuit board 16 and the LEDs 92 mounted to the circuit board 98. The plurality of cavities 104 can be formed prior to encapsulation or after. In the example illustrated in FIG. 10, the plurality of cavities 104 were formed after the encapsulation. Thus, the interior of each of the cavities do not include the encapsulating mask 102. However, in an example, the plurality of cavities 104 can be formed prior to encapsulation and the encapsulating mask 102 can be formed on the surfaces defining the plurality of cavities 104. Furthermore, the encapsulating mask 102 can encapsulate the support member 90 as well. For example, the encapsulating mask 102 can encapsulate all or substantially all of the circuit board 98, e.g., all or substantially all of the front face 100, all or substantially all of an opposing rear face 108 of the circuit board 98, all or substantially all of an edge of the circuit board 98, and all or substantially all of the support member 90.

Figure 11:
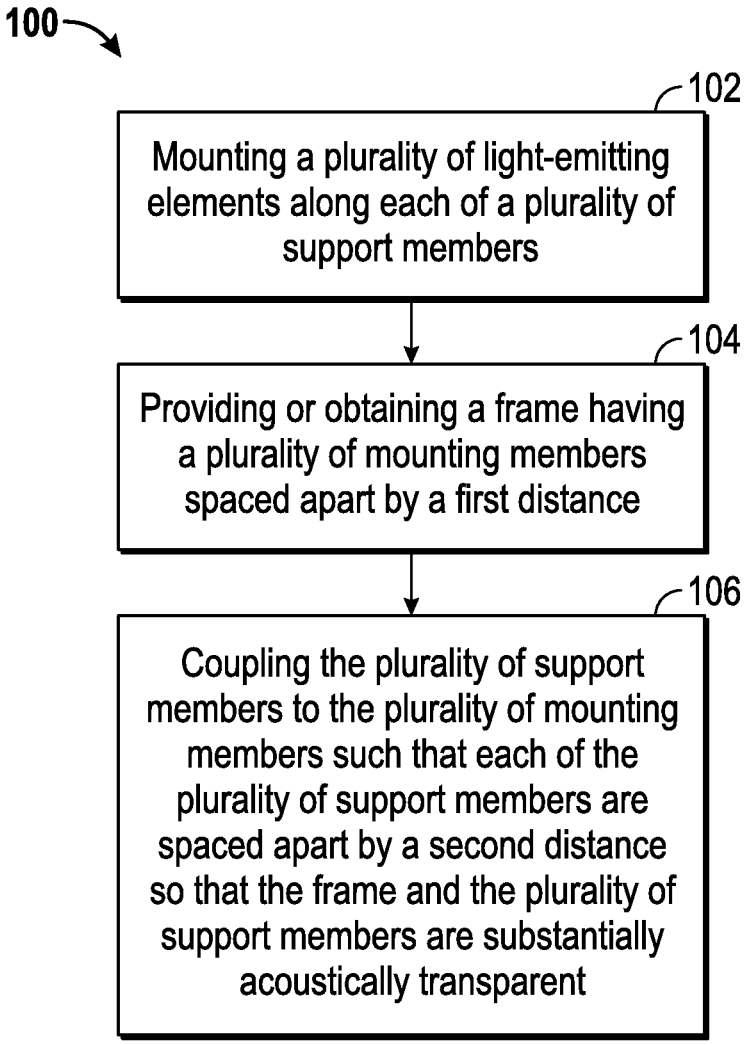
FIG. 11 is a flow chart showing an example method for manufacturing an audio and display system

FIG. 11 is a flow chart showing a method 100 for manufacturing a display module, such as display module 14 including a frame 10, a plurality of support members 16, and a plurality of LEDs 18. The method 100 can include, at 102, mounting a plurality of light-emitting elements 18 (e.g., LEDs) along a plurality of support members 16. In an example, mounting the plurality of LEDs 18 along a plurality of support members 16 can include coupling the plurality of LEDs 18 to a plurality of circuit boards 50 positioned in a recess 48 of the plurality of support members 16. A portion 54 of the plurality of LEDs 18 can project from the recess 48.

The method 100, at 104, can include providing or obtaining a frame having a plurality of mounting members spaced apart by a first distance, such as frame 10 including the frame body 11 and the plurality of mounting members 12 extending between a first surface 26 and a second surface 28 of the frame body 11. The plurality of mounting members 12 can be spaced apart by a first distance 13. The first distance 13 can be equal to or greater than 20 millimeters. As discussed herein, the first distance 13 can be a minimum spacing between adjacent mounting members 12 of the plurality of mounting members 12 that does not adversely affect the sound quality of the at least one audio speaker 6 (shown in FIG. 1). In one example, the plurality of mounting members 12 can be spaced apart by at least 20 millimeters.

The method 100, at 106, can include coupling the plurality of support members to the plurality of mounting members such that each of the plurality of support members are spaced apart by a second distance. For example, the plurality of support members 16 including the plurality of LEDs 18 can be coupled to the plurality of mounting members 12, where each of the plurality of support members 16 are spaced apart by a second distance 20. In an example, the second distance 20 can be within a range about 5 millimeters to about 100 millimeters. As described herein, the second distance 20 is a distance between adjacent support members 16 of the plurality of support members 16 that does not adversely affect the sound quality of the at least one audio speaker 6. Additionally, the second distance 20 is a distance between adjacent support members 38 of the plurality of support members 16 that does not adversely affect the visual quality of the display module 14. The display module 14 (e.g., the plurality of support members 16 (including a plurality of LEDs) coupled to the frame 10) can form an acoustically transparent display. That is, sound can pass through the display module 14 without being substantially adversely affected.

In an example, coupling the plurality of support members 16 to the plurality of mounting members 12 can include coupling a plurality of brackets 60 of a plurality of fastening devices 58 to the plurality of mounting members 12. For example, each of the support members 16 and the brackets 60 can include holes 64, 34 that can be aligned within each other and configured to receive a screw. Coupling the plurality of support members 16 to the plurality of mounting members 12 can include positioning the plurality of support members 16 within an opening 72 defined by compressible extension arms 66 of the fastening device 58. The method 100 can include rotating a cover 64 of the fastening device 58 in a first direction 73 such that projections 76 of the compressible extension arms 66 engage with a ramped surface 82 of first and second ends 80, 82 of the cover 64. The cover 65 can be rotated until the projections 76 are positioned with in the pockets 84 of the first and second ends 80, 82 of the cover 64.

The method 100 can include coupling the display module 14 to a housing 4 having an interior region 8, wherein at least one audio speaker 6 is positioned within the interior region 8. The housing 4 can include the interior region 8, where at least one audio speaker 6 is positioned within the interior region 8. The acoustically transparent display module 14 can be coupled to the housing 4 by hardware, including but not limited to, pins, screws, and clips.

In an example, the method 100 can further include coupling an acoustically transparent scrim between the housing 4 and the frame 10. For example, if the audio and display system 2 is being using in an external environment, the acoustically transparent scrim can provide protection from elements such as leaves, rocks, debris, and animals entering the interior cavity of the housing 4.

In an example, the method 100 can further include forming an encapsulant 52 within the recess 48 of the plurality of support members 16. For example, the encapsulant can be mixed and dispensed using a precision nozzle into the recess 48 of the plurality of support members 16. In an example, the encapsulant can be dispensed until at least the circuit board 50 is covered. In other example, the encapsulant can be dispensed until the open volume of the recess 48 is filled.

In an example, the method 100 can further include forming a contrast enhancement element 56 on the plurality of support members 16. The contrast enhancement element 56 can include, but is not limited to stamped, extruded or molded metal or plastic such as 5052 aluminum sheet, 1034 steel, and polycarbonate. In an example, the contrast enhancement element 56 can be coupled to or onto or around the support member 16 including the plurality of LEDs 18.

Example Section

The present disclosure is explained in greater detail below through illustrative examples.

Equipment

Full range Sounds System (100 Hz to 10 kHz), available from Daktronics. Dual FFT Measurement System (EASERA SysTune), available from AFMG, Rational Acoustics, Meyer Sound Labs.

Sound Devices USBPRe2 Measurement Preamp, available from Sound Devices.

Josephson C55OH Omnidirectional Reference Microphone, available from TestMic.com.

Comparative Example A

A sound system was sent a full range signal and a frequency response (magnitude) was measured with a reference microphone and recorded with the dual FFT Measurement system. Ground plane measurements were taken on an axis at 25 feet increments out to 250 feet. Additional measurements of the sound system were recorded off axis at 10 degree increments to 90 degrees off axis. The results for Comparative Example A are compared to the following Examples 1-3.

Example 1

A substantially acoustically transparent display was placed in front of the sound system. The substantially acoustically transparent display in Example 1 had a plurality of mounting members spaced apart by 500 millimeters and a plurality of support members (including a plurality of LEDs) were coupled to the mounting members and spaced apart by 25 millimeters.

Figure 15B:
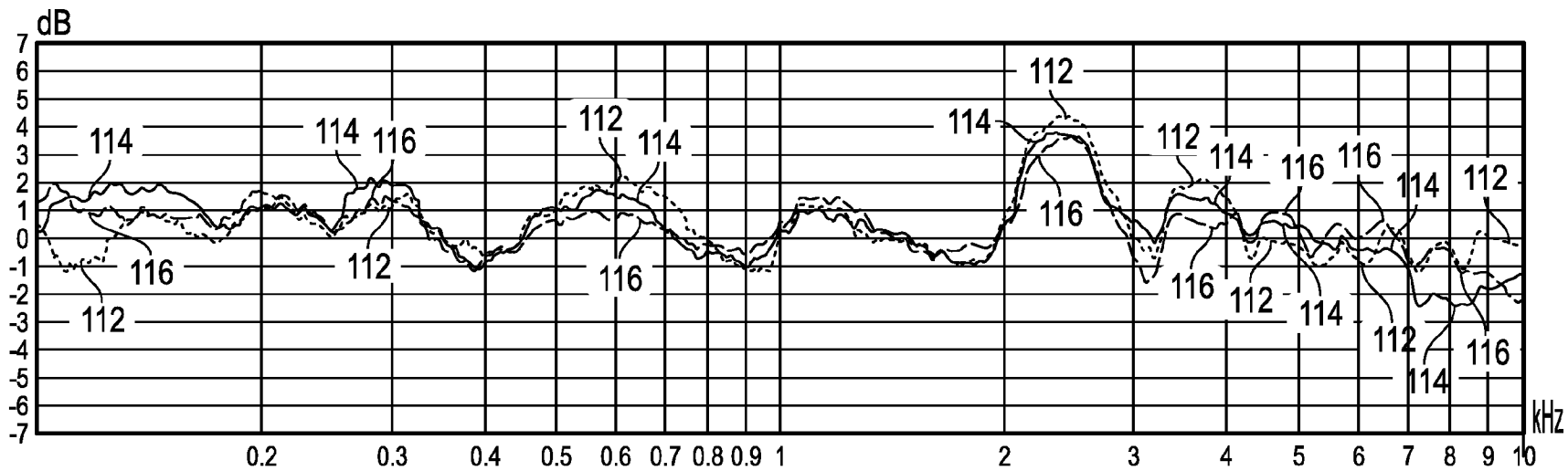
FIG. 15B illustrates results for Examples 1-3.
Figure 16B:
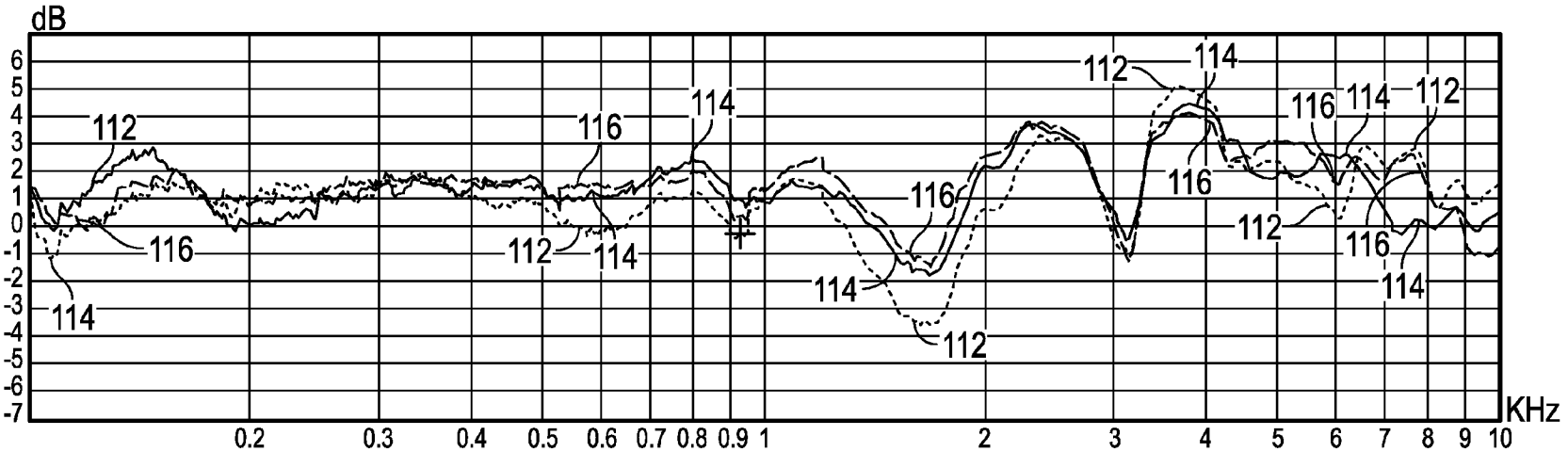
FIG. 16B illustrates results for Examples 1-3
Figure 17:
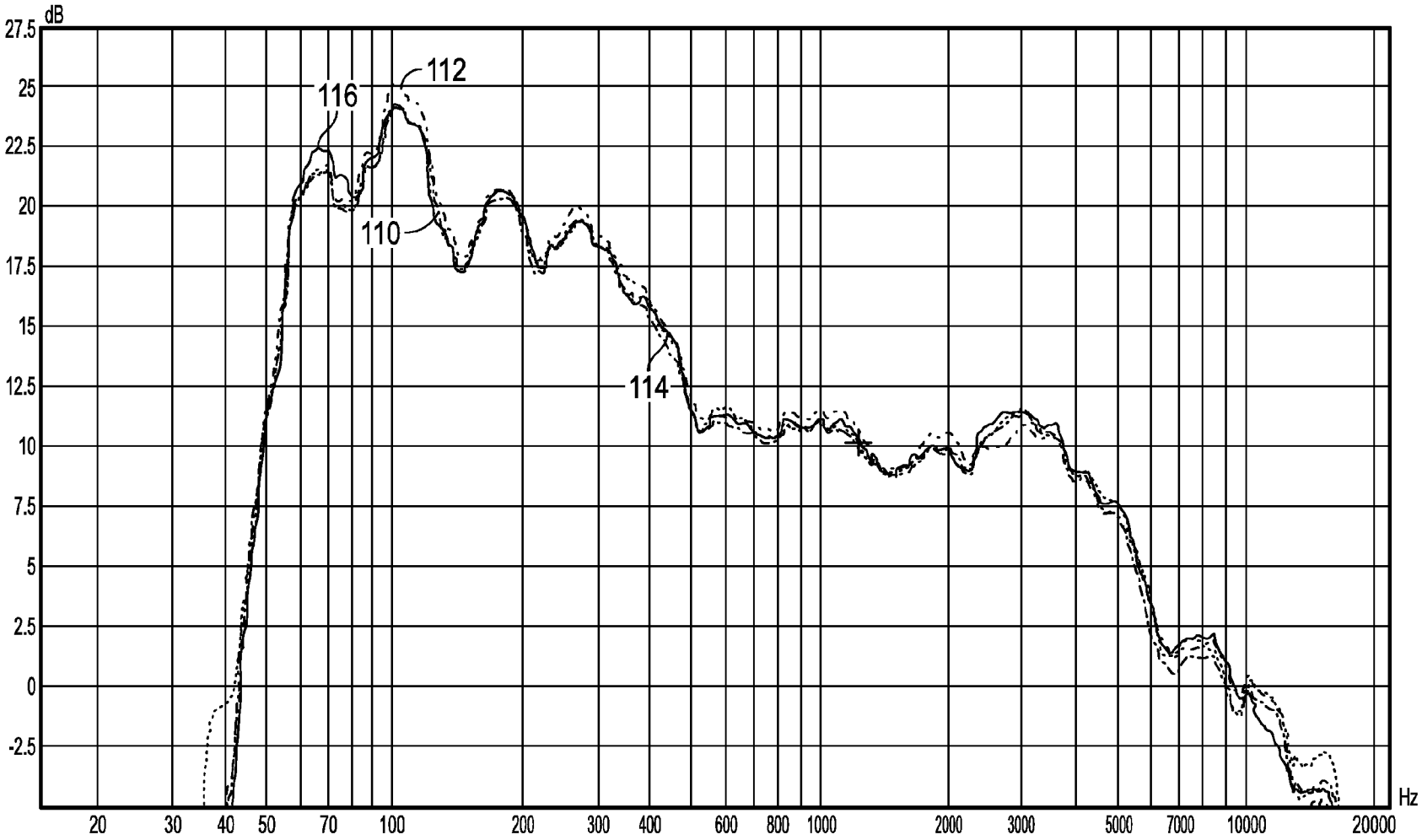
FIG. 17 illustrates results for Examples 1-3

The sound system was sent a full range signal and a frequency response (magnitude) was measured with a reference microphone and recorded with the dual FFT Measurement system. Ground plane measurements were taken on an axis at 25 feet increments out to 250 feet. Additional measurements of the sound system were recorded off axis at 10 degree increments to 90 degrees off axis. The results for Example 1 at 25 feet are shown in FIG. 12, the results for Example 1 at 100 feet are shown in FIG. 15B, the results for Example 1 at 200 feet are shown in FIG. 16B, and the results for Example 1 for off axis measurements are shown in FIG. 17.

Figure 12:
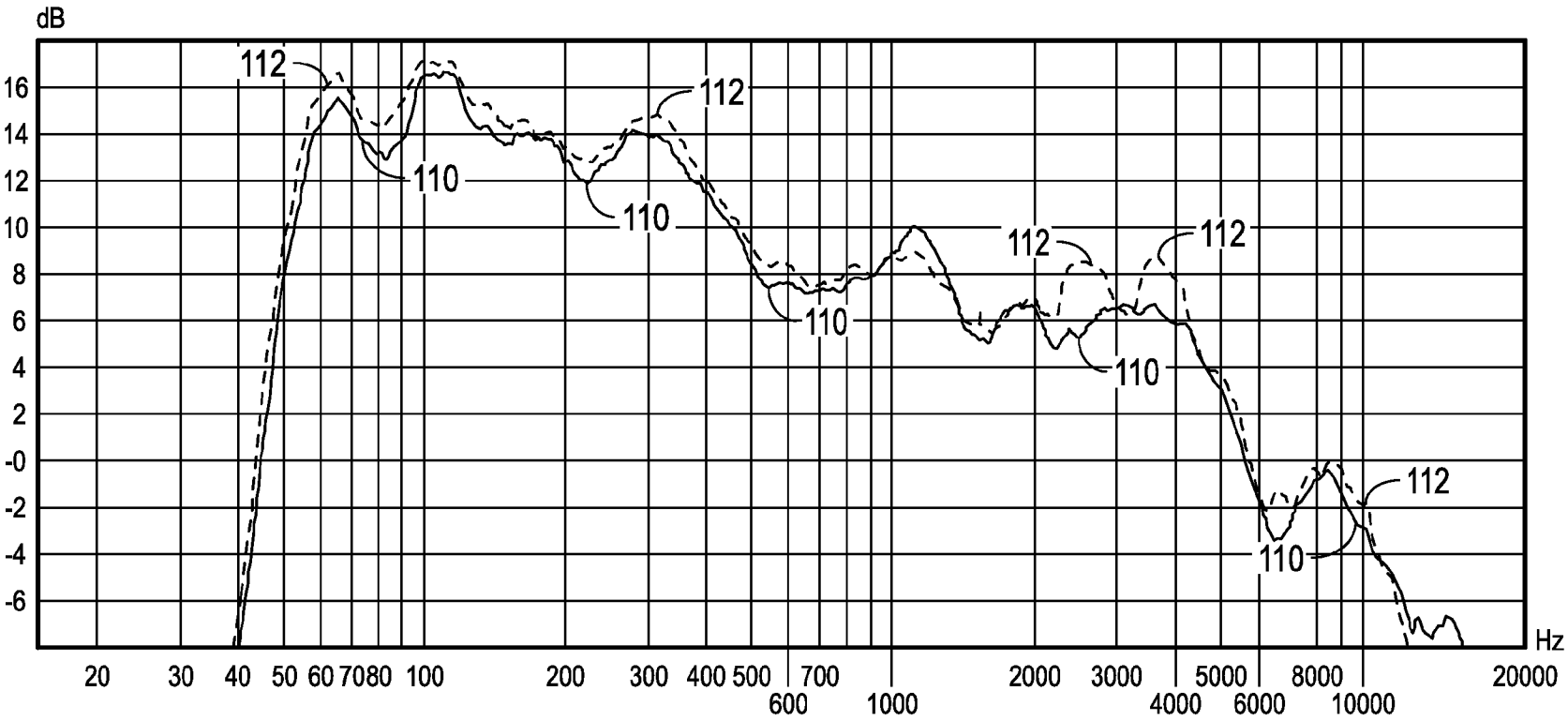
FIG. 12 illustrates results for Example 1.

In FIG. 12, the comparative example A (line 110) represents the measured decibels over an audio frequency range (e.g., from about 20 hertz to about 20000 hertz) without the display placed in front of the sound system. Example 1 (line 112) represents the measured decibels over an audio frequency range for the acoustically transparent display with the mounting members spaced apart by 500 millimeters and the plurality of support members spaced apart by 25 millimeters. As illustrated in FIG. 12, line 112 is within the decibel deviation threshold. That is, line 112 is within +/−3 decibels. Thus, the display in Example 1 is acoustically transparent.

Example 2

A substantially acoustically transparent display was placed in front of the sound system. The substantially acoustically transparent display in Example 1 had a plurality of mounting members spaced apart by 500 millimeters and a plurality of support members (including a plurality of LEDs) were coupled to the mounting members and spaced apart by 40 millimeters.

The sound system was sent a full range signal and a frequency response (magnitude) was measured with a reference microphone and recorded with the dual FFT Measurement system. Ground plane measurements were taken on an axis at 25 feet increments out to 250 feet. Additional measurements of the sound system were recorded off axis at 10 degree increments to 90 degrees off axis. The results for Example 2 at 25 feet are shown in FIG. 13, the results for Example 2 at 200 feet are shown in FIG. 16B, and the results for Example 2 for off axis measurements are shown in FIG. 17.

Figure 13:
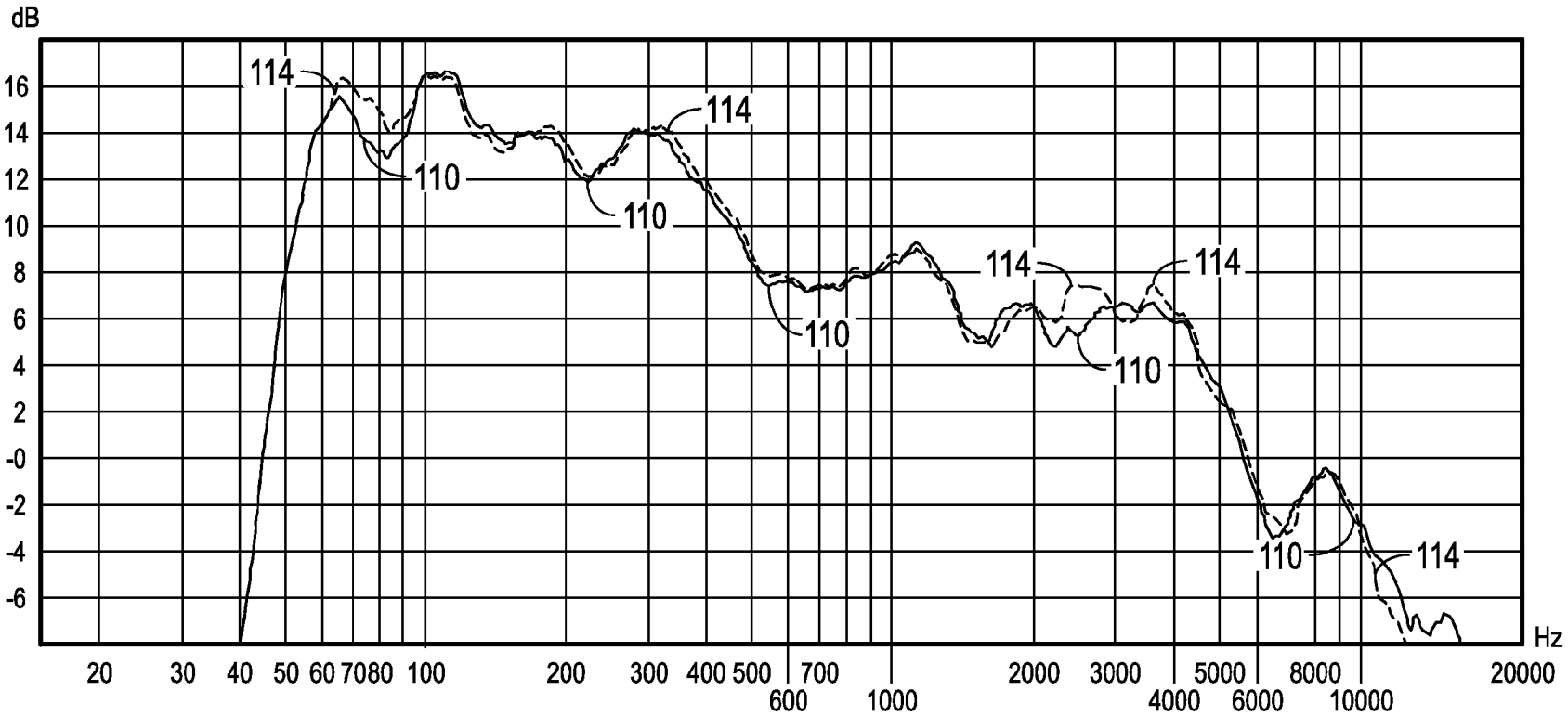
FIG. 13 illustrates results for Example 2.

In FIG. 13, Comparative Example A (line 110) represents the measured decibels over an audio frequency range without the display placed in front of the sound system. Example 2 (line 114) represents the measured decibels over an audio frequency range for the acoustically transparent display with the mounting members spaced apart by 500 millimeters and the plurality of support members spaced apart by 40 millimeters. As illustrated in FIG. 13, line 112 is within the decibel deviation threshold. That is, line 112 is within +/−3 decibels from line 110. Thus, the display in Example 2 is acoustically transparent.

Example 3

A substantially acoustically transparent display was placed in front of the sound system. The substantially acoustically transparent display in Example 1 had a plurality of mounting members spaced apart by 500 millimeters and a plurality of support members (including a plurality of LEDs) were coupled to the mounting members and spaced apart by 50 millimeters.

Figure 14:
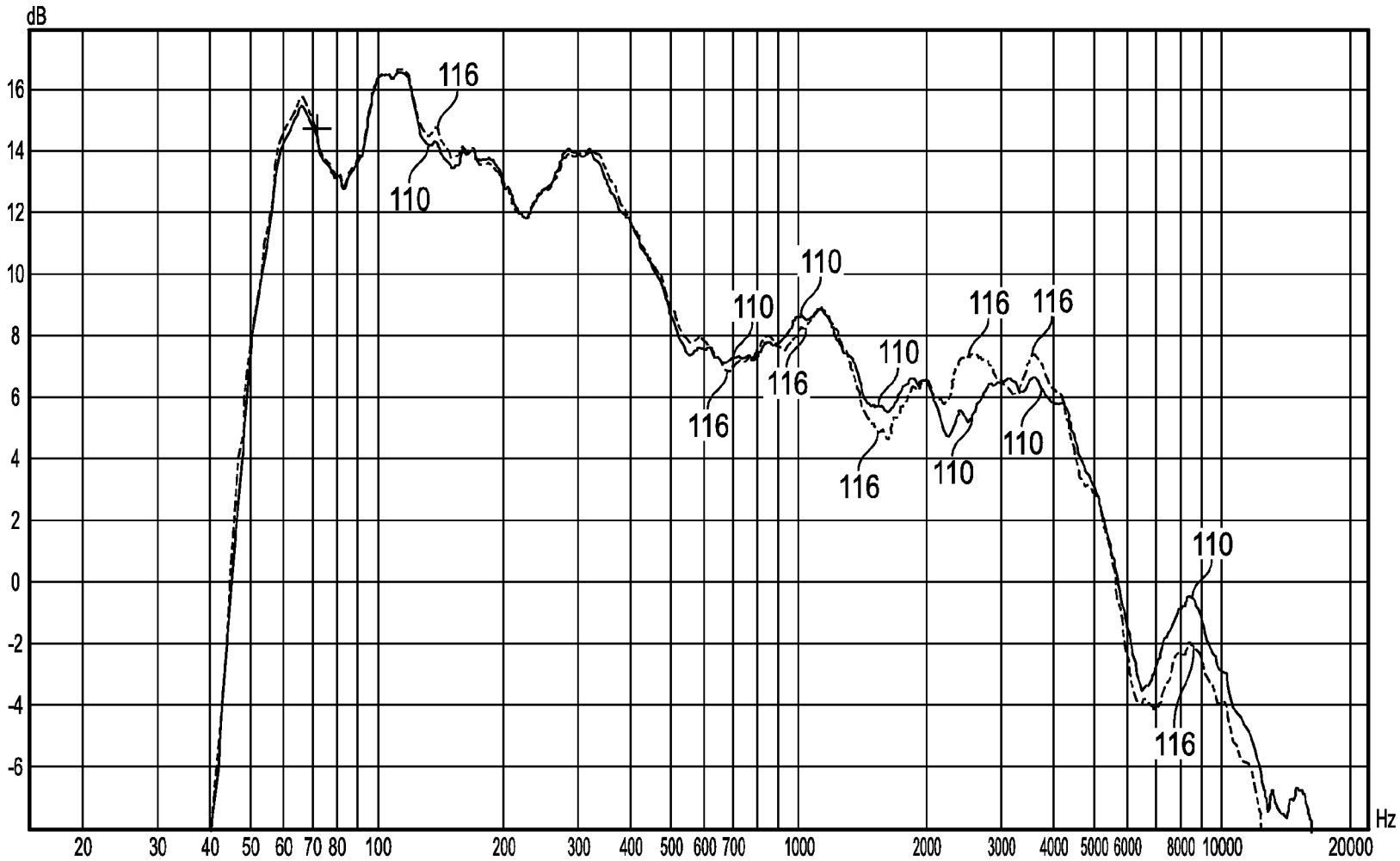
FIG. 14 illustrates results for Example 3.

The sound system was sent a full range signal and a frequency response (magnitude) was measured with a reference microphone and recorded with the dual FFT Measurement system. Ground plane measurements were taken on an axis at 25 feet increments out to 250 feet. Additional measurements of the sound system were recorded off axis at 10 degree increments to 90 degrees off axis. The results of Example 3 are shown in FIG. 14, the results for Example 3 at 200 feet are shown in FIG. 16B, and the results for Example 3 for off axis measurements are shown in FIG. 17.

In FIG. 13, Comparative Example A (line 110) represents the measured decibels over an audio frequency range without the display placed in front of the sound system. Example 2 (line 116) represents the measured decibels over an audio frequency range for the acoustically transparent display with the mounting members spaced apart by 500 millimeters and the plurality of support members spaced apart by 50 millimeters. As illustrated in FIG. 13, line 116 is within the decibel deviation threshold. That is, line 116 is within +/−3 decibels from line 110. Thus, the display in Example 3 is acoustically transparent.

Results for Examples 1-3 at 100 Feet and 200 Feet

Figure 15A:
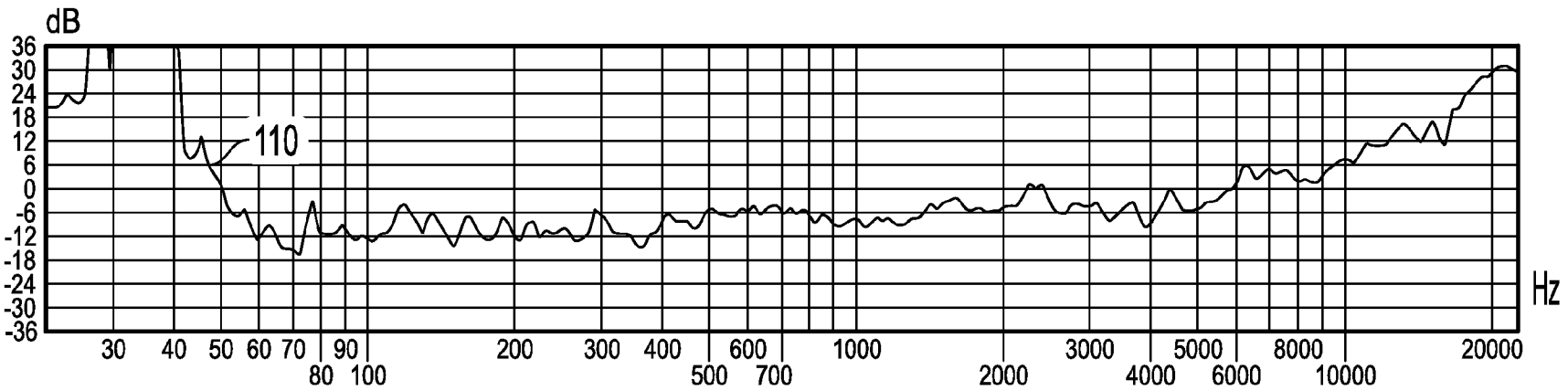
FIG. 15A illustrates results for Comparative Example A.

In FIG. 15A, Comparative Example A (line 110) illustrates the measured decibels from an audio system without a display placed in front of the display system. FIG. 15B illustrates the decibel deviation of Example 1 (line 112), Example 2 (line 114), and Example 3 (line 116) from the line 110. As illustrated in FIG. 15B, Example 1, Example 2, and Example 3 remain within the deviation decibel threshold of +/−6 decibels. Examples 1-3 are within the deviation decibel threshold of +/−3 decibels except for between 2 kHz and 3 kHz, where Examples 2 and 3 are within the deviation decibel threshold of +/−4 decibels and Example 1 is within the deviation decibel threshold of +/15 decibels.

The results in FIGS. 15A and 15B illustrate that Examples 1-3 provide an acoustically transparent display, when measured at 100 feet from the source of the audio.

Results for Examples 1-3 at 200 Feet and 200 Feet

Figure 16A:
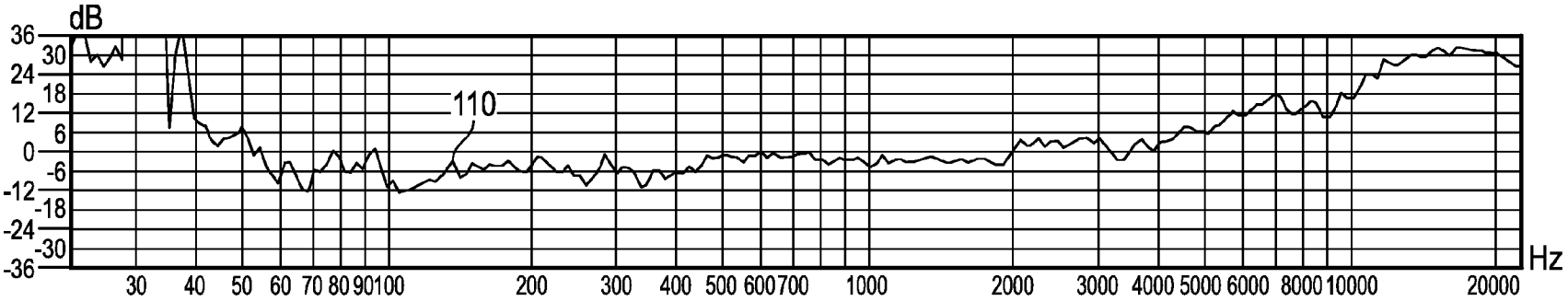
FIG. 16A illustrates results for Comparative Example A.

In FIG. 16A, Comparative Example A (line 110) illustrates the measured decibels from an audio system without a display placed in front of the display system. FIG. 16B illustrates the decibel deviation of Example 1 (line 112), Example 2 (line 114), and Example 3 (line 116) from the line 110. As illustrated in FIG. 16B, Example 1, Example 2, and Example 3 remain within the deviation decibel threshold of +/−6 decibels. Examples 1-3 are within the deviation decibel threshold of +/−3 decibels except for Example 1 between 1 kHz and 2 kHz and Example 1-3 between 3 kHz and 4 kHz. Between 1 kHz and 2 kHz Example 1 is within the deviation decibel threshold of +/−4 decibels and between 3 kHz and 4 kHz Examples 1-2 are within the deviation decibel threshold of +/−5 decibels and Example 3 is within the deviation decibel threshold of +/−6 decibels.

The results in FIGS. 16A and 16B illustrate that Examples 1-3 provide an acoustically transparent display, when measured at 200 feet from the source of the audio.

Results for Examples 1-3 at Off Axis Measurements

In FIG. 17A, the Example 1 (line 112), Example 2 (line 114), and Example 3 (line 116) illustrate the averaged decibel deviation from Comparative Example A at the various off axis measurements. That is, for each example, the decibel deviation was average at each angle and plotted. As illustrated in FIG. 17, Examples 1-3 are within the deviation decibel threshold of +/−3 decibels at the off axis measurements. The results in FIG. 17 illustrate that Examples 1-3 provide an acoustically transparent display when measures off axis at 10 degree increments to 90 degrees.

Various Notes & Examples

Each of these non-limiting examples can stand on its own, or can be combined in any permutation or combination with any one or more of the other examples Example 1 can include subject matter such as an audio and display system. The audio and display system includes a housing having an interior region, at least one audio speaker positioned within the interior region, and a display coupled to the housing. The display includes a frame coupled to the housing, the frame having a plurality of mounting members, wherein at least two adjacent mounting members of the plurality of mounting members are spaced apart by a first distance, a plurality of support members coupled to the mounting members of the frame, wherein at least two adjacent support members of the plurality of support members are spaced apart by a second distance, and a plurality of light-emitting elements coupled to each of the plurality of support members, wherein the display module is substantially acoustically transparent.

Example 2 can include, or can optionally be combined with the subject matter of Example 1, to optionally include where the plurality of support members define a plurality of cavities between adjacent support members of the plurality of support members.

Example 3 can include, or can optionally be combined with the subject matter of Example 1 or 2, to optionally include where a total support member footprint area is equal to or less than about seventy-five percent of a total display footprint area.

Example 4 can include, or can optionally be combined with the subject matter of one or any combination of Examples 1 through 3 to optionally include where the first distance is equal to or greater than 20 millimeters.

Example 5 can include, or can optionally be combined with the subject matter of one or any combination of Examples 1 through 4, to optionally include where the second distance is from about 10 millimeters to about 100 millimeters.

Example 6 can include, or can optionally be combined with the subject matter of Examples 1 through 5 to optionally include where the at least one audio speaker is configured to provide an audio frequency from about 20 hertz to about 20,000 hertz.

Example 7 can include, or can optionally be combined with the subject matter of Examples 1 through 6 to optionally include where each of the plurality of support members include an elongated body having a recess, the recess extending in a longitudinal direction of the elongated body.

Example 8 can include, or can optionally be combined with the subject matter of Examples 1 through 7 to optionally include one or more circuit boards disposed within the recess of each of the plurality of support members.

Example 9 can include, or can optionally be combined with the subject matter of Examples 1 through 8 to optionally include where each of the plurality of light-emitting elements are electrically coupled to a respective circuit board of the one or more circuit boards, and wherein a portion of the plurality of light-emitting elements projects from the recess.

Example 10 can include subject matter such as a display. The display can include a frame having a plurality of mounting members, wherein at least two adjacent mounting members of the plurality of mounting members are spaced apart by a distance, at least one support member mounted to the plurality of mounting members, the at least one support member defining a plurality of cavities, and a plurality of light-emitting elements coupled to the at least one support member, wherein the display is substantially acoustically transparent.

Example 11 can include, or can optionally be combined with the subject matter of Examples 1 through 10 to optionally include where a total support member footprint area is less than or equal to seventy five percent of a total display footprint area.

Example 12 can include, or can optionally be combined with the subject matter of Examples 1 through 11 to optionally include where the distance is equal to or greater than 20 millimeters.

Example 13 can include, or can optionally be combined with the subject matter of Examples 1 through 12 to optionally include where at least one support member includes a plurality of support members, and at least two adjacent support members of the plurality of support members are spaced apart by a second distance.

Example 14 can include, or can optionally be combined with the subject matter of Examples 1 through 13 to optionally include the second distance is from about 20 millimeters to about 2000 millimeters.

Example 15, can include, or can optionally be combined with the subject matter of Examples 1 through 14 to optionally include a plurality of fastening devices configured to couple the plurality of support members to the plurality of mounting members.

Example 16, can include, or can optionally be combined with the subject matter of Examples 1 through 15 to optionally include where each of the plurality of fastening devices includes a bracket having a first face configured to contact a surface of a corresponding one of the plurality of mounting members and a second face opposite the first face, the bracket having two arms extending from the second face defining an space therebetween, wherein a corresponding one of the plurality of support members is disposable within the space, and a cover configured to engage with the two arms to couple the corresponding support member with the corresponding mounting member.

Example 17 can include subject matter such as a method of manufacturing a display. The method can include mounting a plurality of light-emitting elements along each of a plurality of support members, providing or obtaining a frame having a plurality of mounting members spaced apart by a first distance, and coupling the plurality of support members to the plurality of mounting members such that each of the plurality of support members are spaced apart by a second distance so that the frame and the plurality of support members are substantially acoustically transparent.

Example 18 can include, or can optionally be combined with the subject matter of Examples 1 through 17 to optionally include coupling the frame to a housing having an interior region, wherein at least one audio speaker is positioned within the interior region.

Example 19 can include, or can optionally be combined with the subject matter of Examples 1 through 18 to optionally include where mounting the plurality of light-emitting elements along the plurality of support members comprises electrically coupling the plurality of light-emitting elements to a plurality of circuit boards positioned in a recess of each of the plurality of support members such that a portion of the plurality of light-emitting elements projects from the recess.

Example 20 can include, or can optionally be combined with the subject matter of Examples 1 through 19 to optionally include forming an encapsulant within the recess over at least a portion of the plurality of circuit boards and at least a portion of the plurality of light-emitting elements.

The above Detailed Description is intended to be illustrative, and not restrictive. For example, the above-described examples (or one or more elements thereof) can be used in combination with each other. Other embodiments can be used, such as by one of ordinary skill in the art upon reviewing the above description. Also, various features or elements can be grouped together to streamline the disclosure. This should not be interpreted as intending that an unclaimed disclosed feature is essential to any claim. Rather, inventive subject matter can lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented, at least in part. Some examples can include a computer-readable medium or machine-readable medium encoded with instructions operable to configure an electronic device to perform methods or method steps as described in the above examples. An implementation of such methods or method steps can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The Abstract is provided to comply with 37 C.F.R. §1.72(b), to allow the reader to quickly ascertain the nature of the technical disclosure. It is submitted with the understanding that it will not be used to interpret or limit the scope or meaning of the claims.

The claimed invention is:

1. An audio and display system, comprising:

a housing having an interior region;

at least one audio speaker positioned within the interior region; and a display coupled to the housing such that the display is positioned at least partially in front of the at least one audio speaker, the display including:

a frame coupled to the housing, the frame having a plurality of mounting members, wherein at least two adjacent mounting members of the plurality of mounting members are spaced apart by a first distance;

a plurality of support members coupled to the mounting members of the frame, wherein at least two adjacent support members of the plurality of support members are spaced apart by a second distance; and a plurality of light-emitting elements coupled to each of the plurality of support members, wherein the display module is substantially acoustically transparent.

2. The audio and display system of claim 1, wherein the plurality of support members define a plurality of cavities between adjacent support members of the plurality of support members.

3. The audio and display system of claim 2, wherein a total support member footprint area is equal to or less than seventy-five percent of a total display footprint area.

4. The audio and display system of claim 1, wherein the first distance is equal to or greater than 20 millimeters.

5. The audio and display system of claim 1, wherein the second distance is from 10 millimeters to 100 millimeters.

6. The audio and display system of claim 1, wherein the at least one audio speaker is configured to provide an audio frequency from 20 hertz to 20,000 hertz.

7. The audio and display system of claim 1, wherein each of the plurality of support members include an elongated body having a recess, the recess extending in a longitudinal direction of the elongated body.

8. The audio and display system of claim 7, further comprising one or more circuit boards disposed within the recess of each of the plurality of support members.

9. The audio and display system of claim 8, wherein each of the plurality of light-emitting elements are electrically coupled to a respective circuit board of the one or more circuit boards, and wherein a portion of the plurality of light-emitting elements projects from the recess.

10. The audio and display system of claim 1, wherein the second distance is from 20 millimeters to 2000 millimeters.

11. The audio and display system of claim 1, further comprising a plurality of fastening devices configured to couple the plurality of support members to the plurality of mounting members.

12. The audio and display system of claim 11, wherein each of the plurality of fastening devices includes:

a bracket having a first face configured to contact a surface of a corresponding one of the plurality of mounting members and a second face opposite the first face, the bracket having two arms extending from the second face defining an space therebetween, wherein a corresponding one of the plurality of support members is disposable within the space; and a cover configured to engage with the two arms to couple the corresponding support member with the corresponding mounting member.

* * * * *